US007600838B2

(12) United States Patent
Iriguchi

(10) Patent No.: US 7,600,838 B2
(45) Date of Patent: Oct. 13, 2009

(54) INK-DROPLET JETTING APPARATUS

(75) Inventor: Akira Iriguchi, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 463 days.

(21) Appl. No.: 11/698,967

(22) Filed: Jan. 26, 2007

(65) Prior Publication Data

US 2007/0195117 A1 Aug. 23, 2007

(30) Foreign Application Priority Data

Jan. 27, 2006 (JP) ..... 2006-018743

(51) Int. Cl.
*B41J 29/38* (2006.01)
*B41J 2/05* (2006.01)

(52) U.S. Cl. ..... 347/10; 347/57

(58) Field of Classification Search ..... 347/9–11, 347/54, 56, 57

See application file for complete search history.

(56) References Cited

U.S. PATENT DOCUMENTS 6,257,686 B1 7/2001 Takahashi et al.
6,386,665 B2 5/2002 Takahashi et al.
6,412,896 B2 7/2002 Takahashi et al.
6,412,923 B1 7/2002 Takahashi
6,416,149 B2 7/2002 Takahashi
6,595,628 B2 7/2003 Takagi et al.
6,663,208 B2 12/2003 Suzuki et al.
7,370,924 B2 * 5/2008 Sekiguchi ..... 347/10

FOREIGN PATENT DOCUMENTS

JP 2000-052561 2/2000
JP 2001-18388 1/2001
JP 2001-301161 10/2001
JP 2002-234198 8/2002
JP 2002-254634 9/2002

* cited by examiner

*Primary Examiner*—An H Do
(74) *Attorney, Agent, or Firm*—Reed Smtih LLP

(57) ABSTRACT

For forming one dot by jetting a plurality of ink droplets, a drive pulse signal in an ink-droplet jetting apparatus includes a first main pulse for jetting, a first regulating signal which is inserted at a first interval from the first main pulse, and a second regulating pulse which is inserted at a second interval from the first main pulse. The first interval is almost the same as or more than the second interval. Accordingly, the ink-droplet jetting apparatus is capable of jetting the ink droplets stably, and printing at a high speed.

23 Claims, 21 Drawing Sheets

Fig. 4
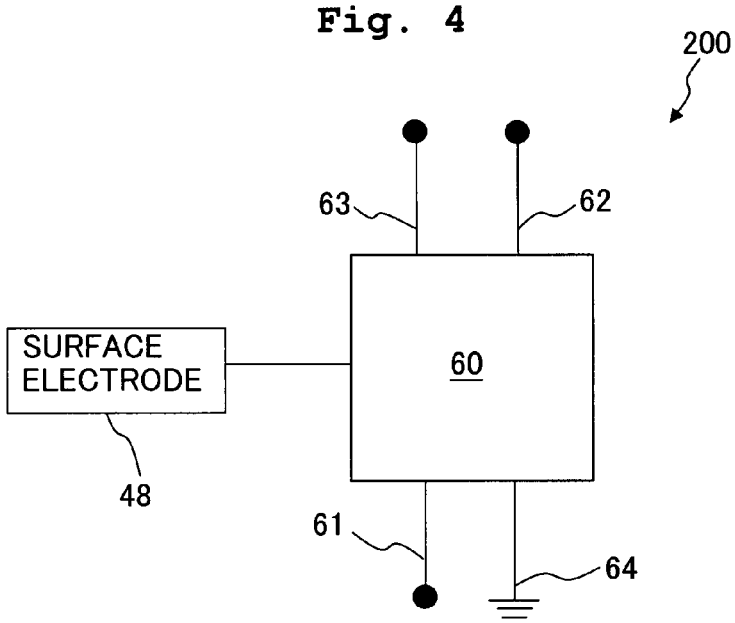
Fig. 5A
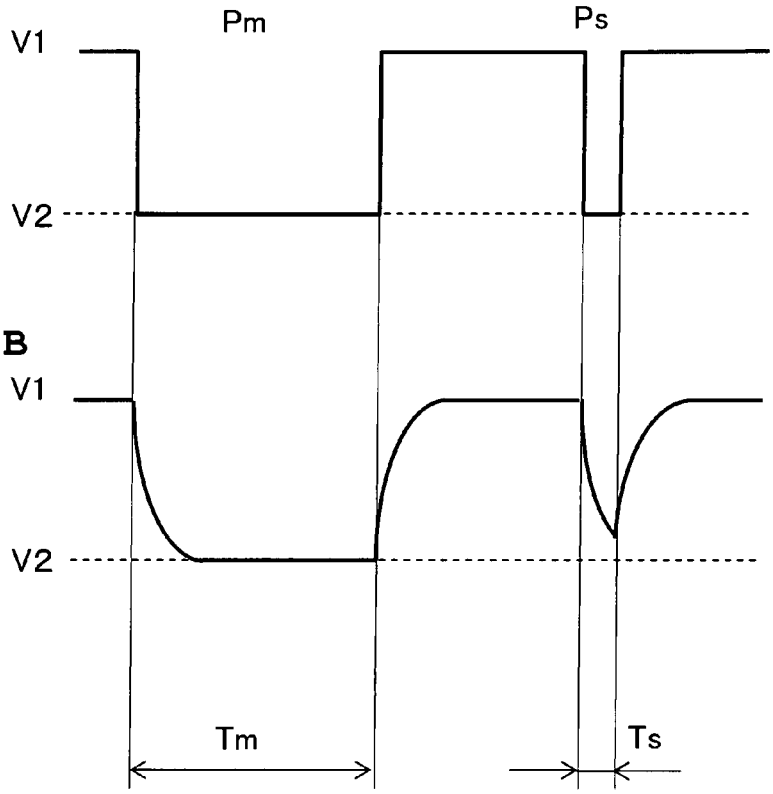
Fig. 5B

Fig. 7

UNIT: μ sec

| | Tm1 | W1 | Ts1 | W2 | Tm2 | W3 | Ts2 | STABILITY |
|---|---|---|---|---|---|---|---|---|
| 1 | 2.8 | 10.1 | 0.8 | 21.6 | 2.8 | 10.1 | 0.8 | − |
| 2 | 3.2 | 10.1 | 0.8 | 21.6 | 3.2 | 10.1 | 0.8 | ± |
| 3 | 3.8 | 10.1 | 0.8 | 21.6 | 3.8 | 10.1 | 0.8 | + |
| 4 | 4.2 | 10.1 | 0.8 | 21.6 | 4.2 | 10.1 | 0.8 | + |
| 5 | 4.6 | 10.1 | 0.8 | 21.6 | 4.6 | 10.1 | 0.8 | + |
| 6 | 5.0 | 10.1 | 0.8 | 21.6 | 5.0 | 10.1 | 0.8 | + |
| 7 | 5.2 | 10.1 | 0.8 | 21.6 | 5.2 | 10.1 | 0.8 | ± |
| 8 | 5.4 | 10.1 | 0.8 | 21.6 | 5.4 | 10.1 | 0.8 | − |
| 9 | 4.6 | 7.6 | 0.8 | 21.6 | 4.6 | 7.6 | 0.8 | − |
| 10 | 4.6 | 8.0 | 0.8 | 21.6 | 4.6 | 8.0 | 0.8 | ± |
| 11 | 4.6 | 8.2 | 0.8 | 21.6 | 4.6 | 8.2 | 0.8 | + |
| 12 | 4.6 | 9.0 | 0.8 | 21.6 | 4.6 | 9.0 | 0.8 | + |
| 13 | 4.6 | 10.1 | 0.8 | 21.6 | 4.6 | 10.1 | 0.8 | + |
| 14 | 4.6 | 11.0 | 0.8 | 21.6 | 4.6 | 11.0 | 0.8 | + |
| 15 | 4.6 | 12.0 | 0.8 | 21.6 | 4.6 | 12.0 | 0.8 | ± |
| 16 | 4.6 | 13.0 | 0.8 | 21.6 | 4.6 | 13.0 | 0.8 | − |
| 17 | 4.6 | 10.1 | 0.2 | 21.6 | 4.6 | 10.1 | 0.2 | − |
| 18 | 4.6 | 10.1 | 0.4 | 21.6 | 4.6 | 10.1 | 0.4 | + |
| 19 | 4.6 | 10.1 | 0.8 | 21.6 | 4.6 | 10.1 | 0.8 | + |
| 20 | 4.6 | 10.1 | 1.2 | 21.6 | 4.6 | 10.1 | 1.2 | + |
| 21 | 4.6 | 10.1 | 1.6 | 21.6 | 4.6 | 10.1 | 1.6 | + |
| 22 | 4.6 | 10.1 | 2.0 | 21.6 | 4.6 | 10.1 | 2.0 | − |
| 23 | 4.6 | 10.1 | 2.4 | 21.6 | 4.6 | 10.1 | 2.4 | − |
| 24 | 4.6 | 10.1 | 0.8 | 10.0 | 4.6 | 10.1 | 0.8 | − |
| 25 | 4.6 | 10.1 | 0.8 | 12.0 | 4.6 | 10.1 | 0.8 | ± |
| 26 | 4.6 | 10.1 | 0.8 | 18.0 | 4.6 | 10.1 | 0.8 | + |
| 27 | 4.6 | 10.1 | 0.8 | 20.0 | 4.6 | 10.1 | 0.8 | + |
| 28 | 4.6 | 10.1 | 0.8 | 21.6 | 4.6 | 10.1 | 0.8 | + |
| 29 | 4.6 | 10.1 | 0.8 | 24.0 | 4.6 | 10.1 | 0.8 | ± |
| 30 | 4.6 | 10.1 | 0.8 | 25.0 | 4.6 | 10.1 | 0.8 | − |

UNIT: μ sec

| | Tm1 | W1 | Ts1 | W2 | Tm2 | W3 | Ts2 | Total |
|---|---|---|---|---|---|---|---|---|
| A | 4.6 | 9.6 | 1 | 21.6 | 4.6 | 9.6 | 1 | 52 |
| B | 4.6 | 9.6 | 1.6 | 21.6 | 4.6 | 9.6 | 1 | 52.6 |
| C | 4.6 | 9.6 | 0.6 | 21.6 | 4.6 | 9.6 | 0.6 | 51.2 |
| D | 4.6 | 9.6 | 0.6 | 21.6 | 4.6 | 9.6 | 1.6 | 52.2 |
| E | 4.6 | 10.6 | 0.6 | 21.6 | 4.6 | 10.6 | 0.6 | 53.2 |
| F | 4.6 | 11.6 | 0.6 | 21.6 | 4.6 | 10.6 | 0.6 | 54.2 |
| G | 4.6 | 10.1 | 0.8 | 21.6 | 4.6 | 9.9 | 0.9 | 52.6 |

Fig. 10A UNIT: μ sec

| | Tm1 | W1 | Tm2 | W2 | Ts1 | W3 | Tm3 | W4 | Ts2 | STABILITY |
|---|---|---|---|---|---|---|---|---|---|---|
| 1 | 2.0 | 6.2 | 4.8 | 9.1 | 1.0 | 15.2 | 4.5 | 2.7 | 1.2 | − |
| 2 | 2.4 | 6.2 | 4.8 | 9.1 | 1.0 | 15.2 | 4.5 | 2.7 | 1.2 | + |
| 3 | 2.8 | 6.2 | 4.8 | 9.1 | 1.0 | 15.2 | 4.5 | 2.7 | 1.2 | + |
| 4 | 3.4 | 6.2 | 4.8 | 9.1 | 1.0 | 15.2 | 4.5 | 2.7 | 1.2 | + |
| 5 | 4.2 | 6.2 | 4.8 | 9.1 | 1.0 | 15.2 | 4.5 | 2.7 | 1.2 | + |
| 6 | 4.8 | 6.2 | 4.8 | 9.1 | 1.0 | 15.2 | 4.5 | 2.7 | 1.2 | ± |
| 7 | 5.4 | 6.2 | 4.8 | 9.1 | 1.0 | 15.2 | 4.5 | 2.7 | 1.2 | − |
| 8 | 2.8 | 3.6 | 4.8 | 9.1 | 1.0 | 15.2 | 4.5 | 2.7 | 1.2 | − |
| 9 | 2.8 | 4.0 | 4.8 | 9.1 | 1.0 | 15.2 | 4.5 | 2.7 | 1.2 | + |
| 10 | 2.8 | 4.8 | 4.8 | 9.1 | 1.0 | 15.2 | 4.5 | 2.7 | 1.2 | + |
| 11 | 2.8 | 5.4 | 4.8 | 9.1 | 1.0 | 15.2 | 4.5 | 2.7 | 1.2 | + |
| 12 | 2.8 | 6.2 | 4.8 | 9.1 | 1.0 | 15.2 | 4.5 | 2.7 | 1.2 | + |
| 13 | 2.8 | 7.0 | 4.8 | 9.1 | 1.0 | 15.2 | 4.5 | 2.7 | 1.2 | + |
| 14 | 2.8 | 7.2 | 4.8 | 9.1 | 1.0 | 15.2 | 4.5 | 2.7 | 1.2 | ± |
| 15 | 2.8 | 7.6 | 4.8 | 9.1 | 1.0 | 15.2 | 4.5 | 2.7 | 1.2 | − |
| 16 | 2.8 | 6.2 | 2.4 | 9.1 | 1.0 | 15.2 | 4.5 | 2.7 | 1.2 | − |
| 17 | 2.8 | 6.2 | 2.8 | 9.1 | 1.0 | 15.2 | 4.5 | 2.7 | 1.2 | ± |
| 18 | 2.8 | 6.2 | 3.2 | 9.1 | 1.0 | 15.2 | 4.5 | 2.7 | 1.2 | + |
| 19 | 2.8 | 6.2 | 4.0 | 9.1 | 1.0 | 15.2 | 4.5 | 2.7 | 1.2 | + |
| 20 | 2.8 | 6.2 | 4.8 | 9.1 | 1.0 | 15.2 | 4.5 | 2.7 | 1.2 | + |
| 21 | 2.8 | 6.2 | 5.2 | 9.1 | 1.0 | 15.2 | 4.5 | 2.7 | 1.2 | + |
| 22 | 2.8 | 6.2 | 5.8 | 9.1 | 1.0 | 15.2 | 4.5 | 2.7 | 1.2 | ± |
| 23 | 2.8 | 6.2 | 4.8 | 9.1 | 1.0 | 15.2 | 4.5 | 2.7 | 1.2 | − |
| 24 | 2.8 | 6.2 | 4.8 | 5.8 | 1.0 | 15.2 | 4.5 | 2.7 | 1.2 | ± |
| 25 | 2.8 | 6.2 | 4.8 | 6.0 | 1.0 | 15.2 | 4.5 | 2.7 | 1.2 | ± |
| 26 | 2.8 | 6.2 | 4.8 | 6.8 | 1.0 | 15.2 | 4.5 | 2.7 | 1.2 | + |
| 27 | 2.8 | 6.2 | 4.8 | 8.0 | 1.0 | 15.2 | 4.5 | 2.7 | 1.2 | + |
| 28 | 2.8 | 6.2 | 4.8 | 9.1 | 1.0 | 15.2 | 4.5 | 2.7 | 1.2 | + |
| 29 | 2.8 | 6.2 | 4.8 | 10.0 | 1.0 | 15.2 | 4.5 | 2.7 | 1.2 | + |
| 30 | 2.8 | 6.2 | 4.8 | 11.6 | 1.0 | 15.2 | 4.5 | 2.7 | 1.2 | ± |
| 31 | 2.8 | 6.2 | 4.8 | 12.0 | 1.0 | 15.2 | 4.5 | 2.7 | 1.2 | ± |
| 32 | 2.8 | 6.2 | 4.8 | 12.4 | 1.0 | 15.2 | 4.5 | 2.7 | 1.2 | − |
| 33 | 2.8 | 6.2 | 4.8 | 9.1 | 0.4 | 15.2 | 4.5 | 2.7 | 1.2 | − |

Fig. 10B

UNIT: μ sec

| | Tm1 | W1 | Tm2 | W2 | Ts1 | W3 | Tm3 | W4 | Ts2 | STABILITY |
|---|---|---|---|---|---|---|---|---|---|---|
| 34 | 2.8 | 6.2 | 4.8 | 9.1 | 0.6 | 15.2 | 4.5 | 2.7 | 1.2 | + |
| 35 | 2.8 | 6.2 | 4.8 | 9.1 | 0.8 | 15.2 | 4.5 | 2.7 | 1.2 | + |
| 36 | 2.8 | 6.2 | 4.8 | 9.1 | 1.0 | 15.2 | 4.5 | 2.7 | 1.2 | + |
| 37 | 2.8 | 6.2 | 4.8 | 9.1 | 1.2 | 15.2 | 4.5 | 2.7 | 1.2 | + |
| 38 | 2.8 | 6.2 | 4.8 | 9.1 | 1.4 | 15.2 | 4.5 | 2.7 | 1.2 | − |
| 39 | 2.8 | 6.2 | 4.8 | 9.1 | 1.6 | 15.2 | 4.5 | 2.7 | 1.2 | − |
| 40 | 2.8 | 6.2 | 4.8 | 9.1 | 1.0 | 4.0 | 4.5 | 2.7 | 1.2 | − |
| 41 | 2.8 | 6.2 | 4.8 | 9.1 | 1.0 | 6.0 | 4.5 | 2.7 | 1.2 | + |
| 42 | 2.8 | 6.2 | 4.8 | 9.1 | 1.0 | 8.0 | 4.5 | 2.7 | 1.2 | + |
| 43 | 2.8 | 6.2 | 4.8 | 9.1 | 1.0 | 12.0 | 4.5 | 2.7 | 1.2 | ± |
| 44 | 2.8 | 6.2 | 4.8 | 9.1 | 1.0 | 16.0 | 4.5 | 2.7 | 1.2 | + |
| 45 | 2.8 | 6.2 | 4.8 | 9.1 | 1.0 | 20.0 | 4.5 | 2.7 | 1.2 | ± |
| 46 | 2.8 | 6.2 | 4.8 | 9.1 | 1.0 | 24.0 | 4.5 | 2.7 | 1.2 | + |
| 47 | 2.8 | 6.2 | 4.8 | 9.1 | 1.0 | 28.0 | 4.5 | 2.7 | 1.2 | − |
| 48 | 2.8 | 6.2 | 4.8 | 9.1 | 1.0 | 15.2 | 2.4 | 2.7 | 1.2 | − |
| 49 | 2.8 | 6.2 | 4.8 | 9.1 | 1.0 | 15.2 | 2.8 | 2.7 | 1.2 | + |
| 50 | 2.8 | 6.2 | 4.8 | 9.1 | 1.0 | 15.2 | 3.2 | 2.7 | 1.2 | + |
| 51 | 2.8 | 6.2 | 4.8 | 9.1 | 1.0 | 15.2 | 4.0 | 2.7 | 1.2 | + |
| 52 | 2.8 | 6.2 | 4.8 | 9.1 | 1.0 | 15.2 | 4.5 | 2.7 | 1.2 | + |
| 53 | 2.8 | 6.2 | 4.8 | 9.1 | 1.0 | 15.2 | 5.0 | 2.7 | 1.2 | ± |
| 54 | 2.8 | 6.2 | 4.8 | 9.1 | 1.0 | 15.2 | 5.6 | 2.7 | 1.2 | ± |
| 55 | 2.8 | 6.2 | 4.8 | 9.1 | 1.0 | 15.2 | 5.8 | 2.7 | 1.2 | − |
| 56 | 2.8 | 6.2 | 4.8 | 9.1 | 1.0 | 15.2 | 4.5 | 1.8 | 1.2 | − |
| 57 | 2.8 | 6.2 | 4.8 | 9.1 | 1.0 | 15.2 | 4.5 | 2.0 | 1.2 | + |
| 58 | 2.8 | 6.2 | 4.8 | 9.1 | 1.0 | 15.2 | 4.5 | 2.4 | 1.2 | + |
| 59 | 2.8 | 6.2 | 4.8 | 9.1 | 1.0 | 15.2 | 4.5 | 2.7 | 1.2 | + |
| 60 | 2.8 | 6.2 | 4.8 | 9.1 | 1.0 | 15.2 | 4.5 | 3.0 | 1.2 | + |
| 61 | 2.8 | 6.2 | 4.8 | 9.1 | 1.0 | 15.2 | 4.5 | 3.8 | 1.2 | ± |
| 62 | 2.8 | 6.2 | 4.8 | 9.1 | 1.0 | 15.2 | 4.5 | 4.0 | 1.2 | ± |
| 63 | 2.8 | 6.2 | 4.8 | 9.1 | 1.0 | 15.2 | 4.5 | 4.4 | 1.2 | − |
| 64 | 2.8 | 6.2 | 4.8 | 9.1 | 1.0 | 15.2 | 4.5 | 2.7 | 0.4 | − |
| 65 | 2.8 | 6.2 | 4.8 | 9.1 | 1.0 | 15.2 | 4.5 | 2.7 | 0.6 | + |
| 66 | 2.8 | 6.2 | 4.8 | 9.1 | 1.0 | 15.2 | 4.5 | 2.7 | 0.8 | + |
| 67 | 2.8 | 6.2 | 4.8 | 9.1 | 1.0 | 15.2 | 4.5 | 2.7 | 1.0 | + |
| 68 | 2.8 | 6.2 | 4.8 | 9.1 | 1.0 | 15.2 | 4.5 | 2.7 | 1.2 | + |
| 69 | 2.8 | 6.2 | 4.8 | 9.1 | 1.0 | 15.2 | 4.5 | 2.7 | 1.5 | ± |
| 70 | 2.8 | 6.2 | 4.8 | 9.1 | 1.0 | 15.2 | 4.5 | 2.7 | 1.6 | − |

UNIT: $\mu$ sec

| | Tm1 | W1 | Tm2 | W2 | Ts1 | W3 | Tm3 | W4 | Ts2 | Total |
|---|---|---|---|---|---|---|---|---|---|---|
| A | 2.8 | 6.3 | 5.0 | 9.0 | 1.0 | 7.5 | 4.5 | 2.5 | 1.5 | 40.1 |
| B | 2.8 | 5.8 | 5.0 | 9.0 | 1.0 | 8.5 | 4.5 | 2.5 | 1.5 | 40.6 |
| C | 2.8 | 6.3 | 4.5 | 9.0 | 1.0 | 8.5 | 4.5 | 2.5 | 1.5 | 40.6 |
| D | 2.8 | 5.8 | 5.0 | 9.0 | 1.0 | 7.5 | 4.5 | 2.5 | 1.0 | 39.1 |
| E | 2.8 | 6.3 | 5.0 | 9.0 | 1.0 | 21.0 | 4.5 | 2.5 | 1.0 | 53.1 |
| F | 2.8 | 6.3 | 3.5 | 9.0 | 1.0 | 19.0 | 4.5 | 2.5 | 1.0 | 49.6 |
| G | 2.8 | 6.3 | 5.0 | 9.0 | 1.0 | 21.0 | 4.5 | 3.0 | 1.0 | 53.6 |
| H | 2.8 | 6.3 | 5.0 | 9.0 | 1.0 | 21.0 | 4.5 | 3.5 | 1.0 | 54.1 |
| I | 2.8 | 6.3 | 5.0 | 9.5 | 1.0 | 23.0 | 4.5 | 3.0 | 1.0 | 56.1 |
| J | 2.8 | 6.2 | 4.8 | 9.1 | 1.0 | 15.2 | 4.5 | 2.7 | 1.2 | 47.5 |

Fig. 13A

UNIT: μ sec

| | Tm1 | W1 | Ts1 | W2 | Tm2 | W3 | Ts2 | W4 | Tm3 | W5 | Ts3 | STABILITY |
|---|---|---|---|---|---|---|---|---|---|---|---|---|
| 1 | 3.0 | 3.6 | 0.9 | 21.0 | 3.0 | 3.6 | 0.9 | 21.0 | 3.0 | 3.6 | 0.9 | − |
| 2 | 3.2 | 3.6 | 0.9 | 21.0 | 3.2 | 3.6 | 0.9 | 21.0 | 3.2 | 3.6 | 0.9 | ± |
| 3 | 3.4 | 3.6 | 0.9 | 21.0 | 3.4 | 3.6 | 0.9 | 21.0 | 3.4 | 3.6 | 0.9 | + |
| 4 | 3.8 | 3.6 | 0.9 | 21.0 | 3.8 | 3.6 | 0.9 | 21.0 | 3.8 | 3.6 | 0.9 | + |
| 5 | 4.5 | 3.6 | 0.9 | 21.0 | 4.5 | 3.6 | 0.9 | 21.0 | 4.5 | 3.6 | 0.9 | + |
| 6 | 4.8 | 3.6 | 0.9 | 21.0 | 4.8 | 3.6 | 0.9 | 21.0 | 4.8 | 3.6 | 0.9 | + |
| 7 | 5.2 | 3.6 | 0.9 | 21.0 | 5.2 | 3.6 | 0.9 | 21.0 | 5.2 | 3.6 | 0.9 | ± |
| 8 | 5.6 | 3.6 | 0.9 | 21.0 | 5.6 | 3.6 | 0.9 | 21.0 | 5.6 | 3.6 | 0.9 | − |
| 9 | 4.5 | 2.6 | 0.9 | 21.0 | 4.5 | 2.6 | 0.9 | 21.0 | 4.5 | 2.6 | 0.9 | − |
| 10 | 4.5 | 2.8 | 0.9 | 21.0 | 4.5 | 2.8 | 0.9 | 21.0 | 4.5 | 2.8 | 0.9 | ± |
| 11 | 4.5 | 3.0 | 0.9 | 21.0 | 4.5 | 3.0 | 0.9 | 21.0 | 4.5 | 3.0 | 0.9 | + |
| 12 | 4.5 | 3.4 | 0.9 | 21.0 | 4.5 | 3.4 | 0.9 | 21.0 | 4.5 | 3.4 | 0.9 | + |
| 13 | 4.5 | 3.6 | 0.9 | 21.0 | 4.5 | 3.6 | 0.9 | 21.0 | 4.5 | 3.6 | 0.9 | + |
| 14 | 4.5 | 4.0 | 0.9 | 21.0 | 4.5 | 4.0 | 0.9 | 21.0 | 4.5 | 4.0 | 0.9 | + |
| 15 | 4.5 | 4.6 | 0.9 | 21.0 | 4.5 | 4.6 | 0.9 | 21.0 | 4.5 | 4.6 | 0.9 | ± |
| 16 | 4.5 | 4.8 | 0.9 | 21.0 | 4.5 | 4.8 | 0.9 | 21.0 | 4.5 | 4.8 | 0.9 | ± |
| 17 | 4.5 | 5.0 | 0.9 | 21.0 | 4.5 | 5.0 | 0.9 | 21.0 | 4.5 | 5.0 | 0.9 | − |
| 18 | 4.5 | 3.6 | 0.4 | 21.0 | 4.5 | 3.6 | 0.4 | 21.0 | 4.5 | 3.6 | 0.4 | − |

Fig. 13B

UNIT: $\mu$ sec

| | Tm1 | W1 | Ts1 | W2 | Tm2 | W3 | Ts2 | W4 | Tm3 | W5 | Ts3 | STABILITY |
|---|---|---|---|---|---|---|---|---|---|---|---|---|
| 19 | 4.5 | 3.6 | 0.6 | 21.0 | 4.5 | 3.6 | 0.6 | 21.0 | 4.5 | 3.6 | 0.6 | + |
| 20 | 4.5 | 3.6 | 0.8 | 21.0 | 4.5 | 3.6 | 0.8 | 21.0 | 4.5 | 3.6 | 0.8 | + |
| 21 | 4.5 | 3.6 | 0.9 | 21.0 | 4.5 | 3.6 | 0.9 | 21.0 | 4.5 | 3.6 | 0.9 | + |
| 22 | 4.5 | 3.6 | 1.0 | 21.0 | 4.5 | 3.6 | 1.0 | 21.0 | 4.5 | 3.6 | 1.0 | ± |
| 23 | 4.5 | 3.6 | 1.2 | 21.0 | 4.5 | 3.6 | 1.2 | 21.0 | 4.5 | 3.6 | 1.2 | ± |
| 24 | 4.5 | 3.6 | 1.4 | 21.0 | 4.5 | 3.6 | 1.4 | 21.0 | 4.5 | 3.6 | 1.4 | − |
| 25 | 4.5 | 3.6 | 0.9 | 16.0 | 4.5 | 3.6 | 0.9 | 16.0 | 4.5 | 3.6 | 0.9 | − |
| 26 | 4.5 | 3.6 | 0.9 | 18.0 | 4.5 | 3.6 | 0.9 | 18.0 | 4.5 | 3.6 | 0.9 | + |
| 27 | 4.5 | 3.6 | 0.9 | 20.0 | 4.5 | 3.6 | 0.9 | 20.0 | 4.5 | 3.6 | 0.9 | + |
| 28 | 4.5 | 3.6 | 0.9 | 21.0 | 4.5 | 3.6 | 0.9 | 21.0 | 4.5 | 3.6 | 0.9 | + |
| 29 | 4.5 | 3.6 | 0.9 | 24.0 | 4.5 | 3.6 | 0.9 | 24.0 | 4.5 | 3.6 | 0.9 | + |
| 30 | 4.5 | 3.6 | 0.9 | 26.0 | 4.5 | 3.6 | 0.9 | 26.0 | 4.5 | 3.6 | 0.9 | ± |
| 31 | 4.5 | 3.6 | 0.9 | 28.0 | 4.5 | 3.6 | 0.9 | 28.0 | 4.5 | 3.6 | 0.9 | − |

Fig. 14

UNIT: $\mu$ sec

| | Tm1 | W1 | Ts1 | W2 | Tm2 | W3 | Ts2 | W4 | Tm3 | W5 | Ts3 | Total |
|---|---|---|---|---|---|---|---|---|---|---|---|---|
| A | 4.5 | 3.6 | 1 | 19 | 4.5 | 3.6 | 1 | 19 | 4.5 | 3.6 | 1 | 65.3 |
| B | 4.5 | 3.6 | 1 | 21 | 4.5 | 3.6 | 1 | 21 | 4.5 | 3.6 | 1 | 69.3 |
| C | 4.5 | 3.6 | 1 | 23 | 4.5 | 3.6 | 1 | 23 | 4.5 | 3.6 | 1 | 73.3 |
| D | 4.5 | 3.6 | 0.6 | 21 | 4.5 | 3.6 | 0.6 | 21 | 4.5 | 3.6 | 0.6 | 68.1 |
| E | 4.5 | 3.6 | 1.2 | 21 | 4.5 | 3.6 | 1.2 | 21 | 4.5 | 3.6 | 1.2 | 69.9 |
| F | 4 | 3.6 | 1 | 21 | 4 | 3.6 | 1 | 21 | 4 | 3.6 | 1 | 67.8 |
| G | 4 | 3.6 | 0.6 | 21 | 4 | 3.6 | 0.6 | 21 | 4 | 3.6 | 0.6 | 66.6 |
| H | 4 | 3.6 | 1.2 | 21 | 4 | 3.6 | 1.2 | 21 | 4 | 3.6 | 1.2 | 68.4 |
| I | 5 | 3.6 | 1 | 21 | 5 | 3.6 | 1 | 21 | 5 | 3.6 | 1 | 70.8 |
| J | 5 | 3.6 | 0.6 | 21 | 5 | 3.6 | 0.6 | 21 | 5 | 3.6 | 0.6 | 69.6 |
| K | 5 | 3.6 | 1.2 | 21 | 5 | 3.6 | 1.2 | 21 | 5 | 3.6 | 1.2 | 71.4 |

Fig. 16

| | Tm1 | W1 | Tm1 | W2 | Ts1 | STABILITY |
|---|---|---|---|---|---|---|
| 1 | 2.2 | 9.1 | 5.2 | 5.7 | 1.1 | − |
| 2 | 2.4 | 9.1 | 5.2 | 5.7 | 1.1 | ± |
| 3 | 2.8 | 9.1 | 5.2 | 5.7 | 1.1 | + |
| 4 | 3.4 | 9.1 | 5.2 | 5.7 | 1.1 | + |
| 5 | 4.0 | 9.1 | 5.2 | 5.7 | 1.1 | + |
| 6 | 4.5 | 9.1 | 5.2 | 5.7 | 1.1 | + |
| 7 | 5.2 | 9.1 | 5.2 | 5.7 | 1.1 | ± |
| 8 | 5.8 | 9.1 | 5.2 | 5.7 | 1.1 | − |
| 9 | 4.5 | 6.4 | 5.2 | 5.7 | 1.1 | − |
| 10 | 4.5 | 6.8 | 5.2 | 5.7 | 1.1 | ± |
| 11 | 4.5 | 7.6 | 5.2 | 5.7 | 1.1 | + |
| 12 | 4.5 | 8.2 | 5.2 | 5.7 | 1.1 | + |
| 13 | 4.5 | 9.1 | 5.2 | 5.7 | 1.1 | + |
| 14 | 4.5 | 10.0 | 5.2 | 5.7 | 1.1 | + |
| 15 | 4.5 | 11.2 | 5.2 | 5.7 | 1.1 | ± |
| 16 | 4.5 | 12.0 | 5.2 | 5.7 | 1.1 | − |
| 17 | 4.5 | 9.1 | 1.4 | 5.7 | 1.1 | − |
| 18 | 4.5 | 9.1 | 2.0 | 5.7 | 1.1 | ± |
| 19 | 4.5 | 9.1 | 2.4 | 5.7 | 1.1 | + |
| 20 | 4.5 | 9.1 | 3.0 | 5.7 | 1.1 | + |
| 21 | 4.5 | 9.1 | 4.8 | 5.7 | 1.1 | + |
| 22 | 4.5 | 9.1 | 5.2 | 5.7 | 1.1 | ± |
| 23 | 4.5 | 9.1 | 6.0 | 5.7 | 1.1 | ± |
| 24 | 4.5 | 9.1 | 6.4 | 5.7 | 1.1 | ± |
| 25 | 4.5 | 9.1 | 6.8 | 5.7 | 1.1 | − |
| 26 | 4.5 | 9.1 | 5.2 | 3.4 | 1.1 | − |
| 27 | 4.5 | 9.1 | 5.2 | 4.0 | 1.1 | ± |
| 28 | 4.5 | 9.1 | 5.2 | 4.2 | 1.1 | + |
| 29 | 4.5 | 9.1 | 5.2 | 5.0 | 1.1 | + |
| 30 | 4.5 | 9.1 | 5.2 | 5.7 | 1.1 | + |
| 31 | 4.5 | 9.1 | 5.2 | 6.8 | 1.1 | + |
| 32 | 4.5 | 9.1 | 5.2 | 9.0 | 1.1 | ± |
| 33 | 4.5 | 9.1 | 5.2 | 10.0 | 1.1 | ± |
| 34 | 4.5 | 9.1 | 5.2 | 11.0 | 1.1 | − |
| 35 | 4.5 | 9.1 | 5.2 | 5.7 | 0.2 | − |
| 36 | 4.5 | 9.1 | 5.2 | 5.7 | 0.4 | + |
| 37 | 4.5 | 9.1 | 5.2 | 5.7 | 0.8 | + |
| 38 | 4.5 | 9.1 | 5.2 | 5.7 | 1.1 | + |
| 39 | 4.5 | 9.1 | 5.2 | 5.7 | 1.8 | + |
| 40 | 4.5 | 9.1 | 5.2 | 5.7 | 2.6 | ± |
| 41 | 4.5 | 9.1 | 5.2 | 5.7 | 3.2 | ± |
| 42 | 4.5 | 9.1 | 5.2 | 5.7 | 3.4 | − |

Fig. 17

| | Tm1 | W1 | Tm1 | W2 | Ts1 | Total |
|---|---|---|---|---|---|---|
| A | 4.6 | 8 | 5 | 4.4 | 0.6 | 22.6 |
| B | 4.6 | 8 | 5 | 4.4 | 1.4 | 23.4 |
| C | 4.6 | 9.2 | 5 | 4.4 | 1.4 | 24.6 |
| D | 4.6 | 10.4 | 5 | 4.4 | 0.6 | 25 |
| E | 4.6 | 9.8 | 5 | 4.4 | 1.4 | 25.2 |
| F | 4.6 | 10.4 | 5 | 4.4 | 1.4 | 25.8 |
| G | 4 | 8.6 | 5.6 | 9.6 | 0.6 | 28.4 |
| H | 4 | 8.6 | 5.6 | 9.6 | 1.2 | 29 |
| I | 4.5 | 9.1 | 5.2 | 5.7 | 1.1 | 25.5 |

Fig. 18A

UNIT: μ sec

| | Tm1 | W1 | Ts1 | W2 | Tm2 | W3 | Tm3 | STABILITY |
|---|---|---|---|---|---|---|---|---|
| 1 | 2.2 | 5.8 | 1.1 | 5.0 | 2.5 | 4.0 | 3.0 | − |
| 2 | 2.8 | 5.8 | 1.1 | 5.0 | 2.5 | 4.0 | 3.0 | + |
| 3 | 3.4 | 5.8 | 1.1 | 5.0 | 2.5 | 4.0 | 3.0 | + |
| 4 | 3.9 | 5.8 | 1.1 | 5.0 | 2.5 | 4.0 | 3.0 | + |
| 5 | 4.5 | 5.8 | 1.1 | 5.0 | 2.5 | 4.0 | 3.0 | + |
| 6 | 5.2 | 5.8 | 1.1 | 5.0 | 2.5 | 4.0 | 3.0 | ± |
| 7 | 5.8 | 5.8 | 1.1 | 5.0 | 2.5 | 4.0 | 3.0 | − |
| 8 | 3.9 | 2.8 | 1.1 | 5.0 | 2.5 | 4.0 | 3.0 | − |
| 9 | 3.9 | 3.2 | 1.1 | 5.0 | 2.5 | 4.0 | 3.0 | ± |
| 10 | 3.9 | 3.6 | 1.1 | 5.0 | 2.5 | 4.0 | 3.0 | + |
| 11 | 3.9 | 4.2 | 1.1 | 5.0 | 2.5 | 4.0 | 3.0 | + |
| 12 | 3.9 | 5.8 | 1.1 | 5.0 | 2.5 | 4.0 | 3.0 | + |
| 13 | 3.9 | 6.8 | 1.1 | 5.0 | 2.5 | 4.0 | 3.0 | + |
| 14 | 3.9 | 8.4 | 1.1 | 5.0 | 2.5 | 4.0 | 3.0 | ± |
| 15 | 3.9 | 8.8 | 1.1 | 5.0 | 2.5 | 4.0 | 3.0 | ± |
| 16 | 3.9 | 9.2 | 1.1 | 5.0 | 2.5 | 4.0 | 3.0 | − |
| 17 | 3.9 | 5.8 | 0.4 | 5.0 | 2.5 | 4.0 | 3.0 | − |
| 18 | 3.9 | 5.8 | 0.6 | 5.0 | 2.5 | 4.0 | 3.0 | + |
| 19 | 3.9 | 5.8 | 1.1 | 5.0 | 2.5 | 4.0 | 3.0 | + |
| 20 | 3.9 | 5.8 | 1.4 | 5.0 | 2.5 | 4.0 | 3.0 | + |
| 21 | 3.9 | 5.8 | 1.6 | 5.0 | 2.5 | 4.0 | 3.0 | ± |
| 22 | 3.9 | 5.8 | 2.0 | 5.0 | 2.5 | 4.0 | 3.0 | − |
| 23 | 3.9 | 5.8 | 2.4 | 5.0 | 2.5 | 4.0 | 3.0 | − |
| 24 | 3.9 | 5.8 | 1.1 | 2.8 | 2.5 | 4.0 | 3.0 | − |
| 25 | 3.9 | 5.8 | 1.1 | 3.2 | 2.5 | 4.0 | 3.0 | ± |
| 26 | 3.9 | 5.8 | 1.1 | 3.6 | 2.5 | 4.0 | 3.0 | + |
| 27 | 3.9 | 5.8 | 1.1 | 4.4 | 2.5 | 4.0 | 3.0 | + |
| 28 | 3.9 | 5.8 | 1.1 | 5.0 | 2.5 | 4.0 | 3.0 | + |
| 29 | 3.9 | 5.8 | 1.1 | 5.8 | 2.5 | 4.0 | 3.0 | + |
| 30 | 3.9 | 5.8 | 1.1 | 6.6 | 2.5 | 4.0 | 3.0 | ± |
| 31 | 3.9 | 5.8 | 1.1 | 7.2 | 2.5 | 4.0 | 3.0 | ± |
| 32 | 3.9 | 5.8 | 1.1 | 7.4 | 2.5 | 4.0 | 3.0 | − |

Fig. 18B

UNIT: $\mu$ sec

| | Tm1 | W1 | Ts1 | W2 | Tm2 | W3 | Tm3 | STABILITY |
|---|---|---|---|---|---|---|---|---|
| 33 | 3.9 | 5.8 | 1.1 | 5.0 | 1.4 | 4.0 | 3.0 | − |
| 34 | 3.9 | 5.8 | 1.1 | 5.0 | 1.6 | 4.0 | 3.0 | ± |
| 35 | 3.9 | 5.8 | 1.1 | 5.0 | 2.0 | 4.0 | 3.0 | + |
| 36 | 3.9 | 5.8 | 1.1 | 5.0 | 2.8 | 4.0 | 3.0 | + |
| 37 | 3.9 | 5.8 | 1.1 | 5.0 | 3.2 | 4.0 | 3.0 | + |
| 38 | 3.9 | 5.8 | 1.1 | 5.0 | 3.6 | 4.0 | 3.0 | − |
| 39 | 3.9 | 5.8 | 1.1 | 5.0 | 4.0 | 4.0 | 3.0 | − |
| 40 | 3.9 | 5.8 | 1.1 | 5.0 | 2.5 | 3.0 | 3.0 | − |
| 41 | 3.9 | 5.8 | 1.1 | 5.0 | 2.5 | 3.2 | 3.0 | ± |
| 42 | 3.9 | 5.8 | 1.1 | 5.0 | 2.5 | 3.8 | 3.0 | + |
| 43 | 3.9 | 5.8 | 1.1 | 5.0 | 2.5 | 4.0 | 3.0 | + |
| 44 | 3.9 | 5.8 | 1.1 | 5.0 | 2.5 | 4.8 | 3.0 | + |
| 45 | 3.9 | 5.8 | 1.1 | 5.0 | 2.5 | 5.6 | 3.0 | ± |
| 46 | 3.9 | 5.8 | 1.1 | 5.0 | 2.5 | 5.8 | 3.0 | − |
| 47 | 3.9 | 5.8 | 1.1 | 5.0 | 2.5 | 4.0 | 1.8 | − |
| 48 | 3.9 | 5.8 | 1.1 | 5.0 | 2.5 | 4.0 | 2.0 | ± |
| 49 | 3.9 | 5.8 | 1.1 | 5.0 | 2.5 | 4.0 | 2.4 | + |
| 50 | 3.9 | 5.8 | 1.1 | 5.0 | 2.5 | 4.0 | 3.0 | + |
| 51 | 3.9 | 5.8 | 1.1 | 5.0 | 2.5 | 4.0 | 3.4 | + |
| 52 | 3.9 | 5.8 | 1.1 | 5.0 | 2.5 | 4.0 | 4.0 | ± |
| 53 | 3.9 | 5.8 | 1.1 | 5.0 | 2.5 | 4.0 | 4.2 | − |

Fig. 19

UNIT: $\mu$ sec

| | Tm1 | W1 | Ts1 | W2 | Tm2 | W3 | Tm3 | Total |
|---|---|---|---|---|---|---|---|---|
| A | 4.0 | 4.0 | 1.4 | 6.0 | 2.5 | 4.0 | 3.0 | 24.9 |
| B | 3.6 | 5.0 | 1.0 | 5.0 | 2.0 | 4.4 | 2.6 | 23.6 |
| C | 4.2 | 6.0 | 0.8 | 4.0 | 2.5 | 4.0 | 3.0 | 24.5 |
| D | 4.0 | 6.0 | 1.2 | 5.0 | 3.0 | 3.8 | 3.2 | 26.2 |
| E | 3.8 | 8.0 | 1.0 | 5.0 | 2.5 | 4.0 | 3.0 | 27.3 |
| F | 3.8 | 4.2 | 7.0 | 3.8 | 3.0 | 5.3 | 3.5 | 30.6 |
| G | 4.5 | 5.0 | 7.0 | 4.5 | 2.0 | 4.5 | 3.2 | 30.7 |
| H | 5.0 | 5.0 | 7.5 | 4.5 | 3.5 | 4.5 | 3.5 | 33.5 |
| I | 4.5 | 4.0 | 7.0 | 3.5 | 3.0 | 5.5 | 3.0 | 30.5 |

INK-DROPLET JETTING APPARATUS

CROSS-REFERENCE TO RELATED APPLICATION

The present application claims priority from Japanese Patent Application No. 2006-018743, filed on Jan. 27, 2006, the disclosure of which is incorporated herein by reference in its entirety.

BACKGROUND OF THE INVENTION

1. Field of the Invention

The present invention relates to an ink-droplet jetting apparatus of an ink-jet type.

2. Description of the Related Art

As a head provided to an ink-jet printer which is an ink-droplet jetting apparatus, an ink-jet head which jets an ink droplet from a nozzle by changing a volume of a pressure chamber in which the ink is filled, by displacing an electromechanical transducer such as a piezoelectric element by applying a drive pulse signal has hitherto been known.

In the abovementioned ink-jet head, a gradation control (a half-toning control) in which, a dot diameter is changed is carried out. For forming one dot by a plurality of ink droplets, the drive pulse signal is set such that a plurality of pulses is applied continuously. For suppressing an effect on a subsequent jetting of vibration which is left in the ink after the ink droplets are jetted (residual vibration), a regulating pulse (canceling pulse) is output after a main pulse which jets the ink. For example, U.S. Pat. No. 6,412,923 (corresponds to Japanese Patent Application Laid-open No. 2001-52561) discloses that, a plurality of pulse sets are output one after another, and the ink-jet head is driven at a frequency of 8.5 kHz by these pulse sets for forming one dot, each of the pulse sets including a first-droplet jetting pulse, a regulating pulse, a second-droplet jetting pulse, and a regulating pulse.

SUMMARY OF THE INVENTION

In an ink-jet printer, one dot is formed not only by a single jetting (one-shot jetting) but also a dot of the same size is formed continuously (continuous jetting) over a predetermined range. Therefore, even when the ink droplets are jetted continuously, a suppressed effect due to a residual vibration, and (capability of) jetting a multiple number of dots stably have been sought.

On the other hand, in recent years, in the ink-jet printers, speeding up of (increase in) a recording speed has been sought. For increasing the recording speed (For performing high-speed recording), it is necessary to increase a drive frequency, or in other words, to shorten (make short) a drive cycle for forming one dot. However, in an ink-jet printer which jets a plurality of ink droplets for one dot, for applying a plurality of pulses, pressure waves (formed) by these pulses are superimposed. Consequently, the residual vibration of the ink becomes complex (complicated) due to the pressure wave, and it becomes difficult to suppress promptly the residual vibration. Therefore, for achieving a desired print quality, it is necessary to make the drive cycle long, but it becomes difficult to perform recording at a high speed (high-speed recording).

Since a width of each pulse of a plurality of pulse signals is related to a time AL in which a pressure wave generated due to a displacement of a piezoelectric actuator is propagated one way through an ink channel (one-way propagation time), for shortening the drive cycle, it is necessary to shorten the one-way propagation time AL. For shortening the one-wave propagation time AL, shortening of ink channels including a pressure chamber can be taken into consideration. However, (when the ink channels are shortened), a length of the pressure chamber which receives a displacement of the piezoelectric actuator becomes short. As a result of this, for imparting the same jetting pressure, it is necessary to increase a drive voltage (to be) applied to the piezoelectric actuator. However, there are limitations on increasing the drive voltage.

An object of the present invention is to realize an ink-droplet jetting apparatus which is an ink jetting apparatus such as an ink-jet printer which jets a plurality of droplets for one dot, which is capable of jetting stably, and increasing the recording speed without causing to decline the drive frequency even when the plurality of ink droplets is jetted.

According to a first aspect of the present invention, there is provided an ink-droplet jetting apparatus which forms one dot by jetting a plurality of ink droplets on to a recording medium, including:

a pressure chamber in which the ink is filled;

an ink channel which communicates with the pressure chamber and which is elongated in a predetermined direction;

an actuator which faces the pressure chamber, and which changes a volume of the pressure chamber to jet the droplets of the ink; and a signal control unit which supplies a drive pulse signal for driving the actuator to form the one dot, the drive pulse signal including: a first main pulse for a jetting operation; a first regulating pulse for suppressing a residual vibration of the ink in the pressure chamber caused by the first main pulse, the first regulating pulse being inserted at a first interval from the first main pulse; a second main pulse for the jetting operation, the second main pulse being inserted at a second interval from the first regulating pulse; and a second regulating pulse for suppressing a residual vibration of the ink in the pressure chamber caused by the second main pulse, the second regulating pulse being supplied after the second main pulse.

The first interval is in a range of 2 AL to 3 AL, and the second interval is in a range of 3 AL to 6 AL, provided that AL is a time during which a pressure wave generated in the ink channel communicating with the pressure chamber due to the change in the volume of the pressure chamber, is propagated one way in a longitudinal direction of the ink channel.

According to the first aspect of the present invention, at the time of forming one dot by jetting the plurality of ink droplets by the plurality of main pulses, the residual vibration of the ink is suppressed by the first regulating pulse which is inserted between the plurality of main pulses, and the second regulating pulse which is in continuation with the plurality of main pulses. Since for the main pulse immediately after the first regulating pulse, an interval from a tail end of the first regulating pulse is set to be almost the same as or more than an interval between the main pulse and the first regulating pulse immediately after the main pulse, it is possible to suppress effectively the residual vibration of the ink, and to increase a recording speed, as it is possible to drive with a short cycle. Concretely, by letting the plurality of main pulses to be two main pulses, the first interval with respect to the time AL in which the pressure wave generated in the ink channel communicating with the pressure chamber due to the change in the volume of the pressure chamber, is propagated one way in the longitudinal direction of the ink channel to be not less than 2 AL and not more 3 AL, and the second interval to be not less than 3 AL and not more than 6 AL, it is possible to suppress effectively the residual vibration of the ink in a structure with two main pulses, and to increase the recording speed, as it is possible to drive with a short cycle.

In the ink-droplet jetting apparatus of the present invention, a number of pulses which are included in the drive pulse signal may be even. In this case, it is possible to suppress effectively the residual vibration of the ink, and to increase the recording speed.

In the ink-droplet jetting apparatus of the present invention, following relationships may be satisfied:

0.8 AL≦Tm1≦1.3 AL,
2.0 AL≦W1≦3.0 AL,
0.1 AL≦Ts1≦0.4 AL,
3.0 AL≦W2≦6.0 AL,
0.8 AL≦Tm2≦1.3 AL,
2.0 AL≦W3≦3.0 AL, and
0.1 AL≦Ts2≦0.4 AL;

provided that Tm1 is a pulse width of the first main pulse, Tm2 is a pulse width of the second main pulse, Ts1 is a pulse width of the first regulating pulse, Ts2 is a pulse width of the second regulating pulse, W1 is the first interval, W2 is the second interval, and W3 is a third interval between a tail end of the second main pulse and a head end of the second regulating pulse. In this case, it is possible to suppress effectively the residual vibration of the ink and to increase the recording speed, as it is possible to drive with a short cycle.

In the ink-droplet jetting apparatus of the present invention, following relationships may further be satisfied 1.05 AL≦Tm1≦1.25 AL,
2.25 AL≦W1≦2.9 AL,
0.1 AL≦Ts1≦0.4 AL,
5.0 AL≦W2≦5.4 AL,
1.05 AL≦Tm2≦1.25 AL,
2.25 AL≦W3≦2.75 AL, and
0.1 AL≦Ts2≦0.4 AL.

In this case, it is possible to suppress effectively the residual vibration of the ink, and to increase the recording speed, as it is possible to drive with a short cycle.

According to a second aspect of the present invention, there is provided an ink-droplet jetting apparatus which forms one dot by jetting a plurality of ink droplets on to a recording medium, including:

a pressure chamber in which the ink is filled;

an ink channel which communicates with the pressure chamber and which is elongated in a predetermined direction;

an actuator which faces the pressure chamber, and which changes a volume of the pressure chamber to jet the droplets of the ink; and a signal control unit which supplies a drive pulse signal for driving the actuator to form the one dot, the drive pulse signal including: three main pulses for a jetting operation; a first regulating pulse for suppressing a residual vibration of the ink in the pressure chamber caused by a main pulse among the main pulses immediately before the first regulating pulse, the first regulating pulse being inserted between the three main pulses at a first interval from the main pulse immediately before the first regulating pulse and at a second interval from another main pulse among the main pulses immediately after the first regulating pulse; and a second regulating pulse for suppressing a residual vibration of the ink in the pressure chamber caused by the last pulse of the main pulses, the second regulating pulse being added in continuation with the three main pulses. The first interval is in a range of 0.7 AL to 1.2 AL, and the second interval is in a range of 4.5 AL to 6.5 AL, provided that AL is a time during which a pressure wave, generated in the ink channel communicating with the pressure chamber due to the change in the volume of the pressure chamber, is propagated one way in a longitudinal direction of the ink channel.

According to the second aspect of the present invention, by letting the first interval to be not less than 0.7 AL and not more than 1.2 AL, and the second interval to be not less than 4.5 AL and not more than 6.5 AL, in a structure with three main pulses, it is possible to suppress effectively the residual vibration of the ink, and to increase the recording speed, as it is possible to drive with a short cycle.

In the ink-droplet jetting apparatus of the present invention, a number of pulses which are included in the drive pulse signal may be even. In this case, it is possible to suppress effectively the residual vibration of the ink.

In the ink-droplet jetting apparatus of the present invention, following relationships may be satisfied:

0.8 AL≦Tm1≦1.3 AL,
0.7 AL≦W1≦1.2 AL,
0.15 AL≦Ts1≦0.3 AL,
4.5 AL≦W2≦6.5 AL,
0.8 AL≦Tm2≦1.3 AL,
0.7 AL≦W3≦1.2 AL,
0.15 AL≦Ts2≦0.3 AL,
4.5 AL≦W4≦6.5 AL,
0.8 AL≦Tm3≦1.3 AL,
0.7 AL≦W5≦1.2 AL, and
0.15 AL≦Ts3≦0.3 AL;

provided that Tm1 is a pulse width of the first main pulse of the main pulses, Tm2 is a pulse width of the second main pulse of the main pulses, Tm3 is a pulse width of the third main pulse of the main pulses, the first regulating pulse is inserted between the first main pulse and the second main pulse, and Ts1 is a pulse width of the first regulating pulse, Ts2 is a pulse width of the first regulating pulse, Ts3 is a pulse width of the second regulating pulse, W1 is an interval between a tail end of the first main pulse and a head end of the first regulating pulse supplied next to the first main pulse, W2 is an interval between a head end of the second main pulse and a tail end of the first regulating pulse immediately before the second main pulse, W3 is an interval between a tail end of the second main pulse and a head end of the first regulating pulse supplied next to the second main pulse, W4 is an interval between a head end of the third main pulse and a tail end of the first regulating pulse immediately before the third main pulse, and W5 is an interval between a tail end of the third main pulse and a head end of the second regulating pulse supplied next to the third main pulse.

In this case, it is possible to suppress effectively the residual vibration of the ink, and to increase the recording speed, as it is possible to drive with a short cycle.

In the ink-droplet jetting apparatus of the present invention, following relationships may further be satisfied 1.0 AL≦Tm1≦1.25 AL,
0.85 AL≦W1≦1.0 AL,
0.15 AL≦Ts1≦0.3 AL,
4.75 AL≦W2≦5.75 AL,
1.0 AL≦Tm2≦1.25 AL,
0.85 AL≦W3≦1.0 AL,
0.15 AL≦Ts2≦0.3 AL,
4.75 AL≦W4≦5.75 AL,
1.0 AL≦Tm3≦1.25 AL,
0.85 AL≦W5≦1.0 AL, and
0.15 AL≦Ts3≦0.3 AL.

In this case also, it is possible to suppress effectively the residual vibration of the ink, and to increase the recording speed, as it is possible to drive with a short cycle.

According to a third aspect of the present invention, there is provided an ink-droplet jetting apparatus which forms one dot by jetting a plurality of ink droplets on to a recording medium, including:

a pressure chamber in which the ink is filled;

an ink channel which communicates with the pressure chamber and which is elongated in a predetermined direction;

an actuator which faces the pressure chamber, and which changes a volume of the pressure chamber to jet the droplets of the ink; and a signal control unit which supplies a drive pulse signal for driving the actuator to form the one dot, the drive pulse signal including: three main pulses for a jetting operation; a first regulating pulse for suppressing a residual vibration of the ink in the pressure chamber caused by the second main pulse of the main pulses, the first regulating pulse being inserted at a first interval from the second main pulse of the main pulses and at a second interval from the third main pulse of the main pulses; and a second regulating pulse for suppressing a residual vibration of the ink in the pressure chamber caused by the third main pulse, the second regulating pulse being added next to the three main pulses. The first interval is in a range of 1.5 AL to 3 AL, and the second interval is in a range of 1.5 AL to 6 AL, provided that AL is a time during which a pressure wave, generated in the ink channel communicating with the pressure chamber due to the change in the volume of the pressure chamber, is propagated one way in a longitudinal direction of the ink channel.

In this case, since the first regulating pulse is inserted between the second main pulse and the third main pulse, the first interval with respect to the time AL in which the pressure wave generated in the ink channel communicating with the pressure chamber due to the change in the volume of the pressure chamber, is propagated one way in the longitudinal direction of the ink channel AL is let to be not less than 1.5 AL and not more than 3 AL, and the second interval with respect to the time AL is let to be not less than 1.6 AL and not more than 6 AL, in a structure with three main pulses, it is possible to suppress effectively the residual vibration of the ink.

In the ink-droplet jetting apparatus of the present invention, following relationships may be satisfied:

$0.6\ AL \leqq Tm1 \leqq 1.2\ AL$, $1.0\ AL \leqq W1 \leqq 1.8\ AL$, $0.7\ AL \leqq Tm2 \leqq 1.45\ AL$, $1.5\ AL \leqq W2 \leqq 3.0\ AL$, $0.15\ AL \leqq Ts1 \leqq 0.3\ AL$, $1.5\ AL \leqq W3 \leqq 6.0\ AL$, $0.7\ AL \leqq Tm3 \leqq 1.4\ AL$, $0.5\ AL \leqq W4 \leqq 1.0\ AL$, and $0.15\ AL \leqq Ts2 \leqq 0.38\ AL$;

provided that Tm1 is a pulse width of the first main pulse of the main pulses, Tm2 is a pulse width of the second main pulse of the main pulses, Tm3 is a pulse width of the third main pulse of the main pulses, Ts1 is a pulse width of the first regulating pulse supplied next to the second main pulse, Ts2 is a pulse width of the second regulating pulse supplied next to the third main pulse, W1 is an interval between a tail end of the first main pulse and a head end of the second main pulse supplied next to the first main pulse, W2 is an interval between a tail end of the second main pulse and a head end of the first regulating pulse supplied next to the second main pulse, W3 is an interval between a head end of the third main pulse and a tail end of the first regulating pulse immediately before the third main pulse, and W4 is an interval between a tail end of the third main pulse and a head end of the second regulating pulse supplied next to the third main pulse. In this case, it is possible to suppress effectively the residual vibration of the ink, and to increase the recording speed, as it is possible to drive with a short cycle.

In the ink-droplet jetting apparatus of the present invention, following relationships may further be satisfied $0.6\ AL \leqq Tm1 \leqq 0.85\ AL$, $1.2\ AL \leqq W1 \leqq 1.58\ AL$, $0.88\ AL \leqq Tm2 \leqq 1.25\ AL$, $2.25\ AL \leqq W2 \leqq 2.38\ AL$, $0.2\ AL \leqq Ts1 \leqq 0.3\ AL$, $1.88\ AL \leqq W3 \leqq 5.75\ AL$, $0.7\ AL \leqq Tm3 \leqq 1.12\ AL$, $0.63\ AL \leqq W4 \leqq 0.75\ AL$, and $0.25\ AL \leqq Ts2 \leqq 0.38\ AL$.

In this case, it is possible to suppress effectively the residual vibration of the ink, and to increase the recording speed, as it is possible to drive with a short cycle.

In the ink-droplet jetting apparatus of the present invention, a voltage in a range of a first voltage and a second voltage may be applied to the actuator; and a width of each of the main pulses may be set to be a period to an extent that the voltage, applied to the actuator, has a period during which the voltage reaches from the first voltage to the second voltage, and a width of each of the first and second regulating pulses may be set to be a period to an extent that the voltage, applied to the actuator, has a period during which the voltage does not reach from the first voltage to the second voltage.

In this case, each main pulse is a pulse having a pulse width sufficient for the voltage applied to the actuator to reach from one voltage value to the other voltage value, out of two voltage values set in for driving the actuator, and each regulating pulse is a pulse having a pulse width to be set short such that the voltage applied to the actuator does not reach from one voltage value to the other voltage value. Therefore, a length of an overall (entire) drive pulse signal becomes short, and it is possible to increase the recording speed, as it is possible to drive with a short cycle.

In the ink-droplet jetting apparatus of the present invention, each of the first and second main pulses and the first and second regulating pulses may drive the actuator to increase the volume of the pressure chamber at a head end thereof, and then decrease the volume of the pressure chamber at a tail end thereof. In this case, by driving the actuator by the main pulse and the regulating pulse such that the main pulse and the regulating pulse increase the volume of the pressure chamber at the head end of the pulse and decrease the volume of the pressure chamber at the tail end of the pulse, it is possible to make short the length of the overall drive pulse signal, and to realize easily the high-speed recording.

In the ink-droplet jetting apparatus of the present invention, the actuator may be a piezoelectric element which is displaced with respect to the pressure chamber when a voltage is applied to the piezoelectric element. In this case, it is possible to perform printing at a high speed in the ink-droplet jetting apparatus.

In the ink-droplet jetting apparatus of the present invention, the signal control unit may include:

a drive pulse generating mechanism which generates a pulse signal including a first drive pulse signal for driving the actuator selectively in a predetermined jetting cycle to form the one dot and which has a plurality of pulses for jetting the plurality of droplets of the ink respectively and generated within the predetermined jetting cycle, and a second drive pulse signal which includes the drive pulse signal in which the plurality of pulses is generated during a jetting cycle and an adjacent jetting cycle thereto; and a drive pulse selecting mechanism which selects one of the first and second pulse signals, based on a presence or an absence of dot information of the adjacent jetting cycle, and outputs the selected signal to the actuator; and the drive pulse selecting mechanism selects the second drive pulse signal when dot information of the predetermined jetting cycle is 'jetting', and dot information of a subsequent jetting cycle to the predetermined jetting cycle is 'no jetting'

In this case, when the dot information of the current jetting cycle is 'jetting', and the dot information of the subsequent jetting cycle is 'no jetting', by jetting while the drive pulse signal is spread over the adjacent jetting cycle, it is possible to suppress effectively the residual vibration of the ink, and to increase the recording speed.

BRIEF DESCRIPTION OF THE DRAWINGS

FIG. 4 is a block diagram of a control unit;

FIG. 5A is a schematic diagram showing a pulse in a drive pulse signal;

FIG. 5B is a schematic diagram showing a voltage applied;

FIG. 7 is a table showing experiment results of the drive pulse signal which includes four pulses;

FIG. 10A is a table showing experiment results of the drive pulse signal which includes five pulses;

FIG. 10B is a table showing the experiment results of the drive pulse signal which includes five pulses;

FIG. 13A is a table showing experiment results of the drive pulse signal which includes six pulses;

FIG. 13B is a table showing the experiment results of the drive pulse signal which includes six pulses;

FIG. 14 is a table showing other experiment results of the drive pulse signal which includes six pulses;

FIG. 16 is a table showing experiment results of a drive pulse signal which includes three pulses;

FIG. 17 is a table showing other experiment results of the drive pulse signal which includes three pulses;

FIG. 18A is a table showing experiment results of a drive pulse which includes four pulses;

FIG. 18B is a table showing the experiment results of the drive pulse which includes four pulses;

FIG. 19 is a table showing other experiment results of the drive pulse which includes four pulses;

DETAILED DESCRIPTION OF THE PREFERRED EMBODIMENTS

Figure 21:
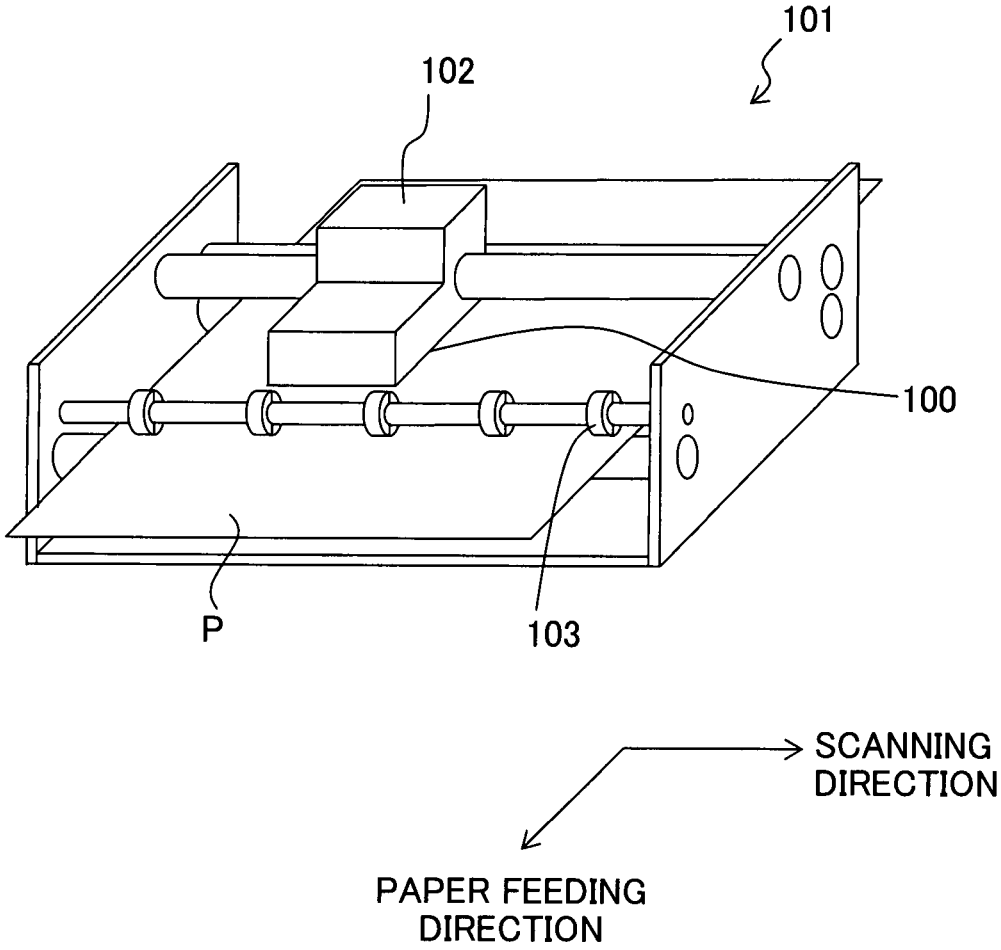
FIG. 21 is a schematic diagram showing an ink-droplet jetting apparatus.

A basic embodiment of the present invention will be described below with reference to FIGS. 1 to 8, and 21. As shown in FIG. 21, an ink-jet printer (ink-droplet jetting apparatus) 101 includes a carriage 102 which is movable in a scanning direction (left and right direction in FIG. 21), an ink-jet head 100 which is formed to be movable along with the carriage 102, and which jets an ink onto a recording paper P, and paper transporting rollers 103 which transport the recording paper P in a paper feeding direction (frontward direction in FIG. 21). Moreover, the ink-jet head 100 performs printing on the recording paper P by jetting ink droplets from nozzles 4 arranged in a lower surface thereof (refer to FIG. 3), while moving integrally with the carriage 102 in the scanning direction. The recording paper P printed by the ink-jet head 100 is discharged in the paper feeding direction by the paper transporting rollers 103.

Figure 1:
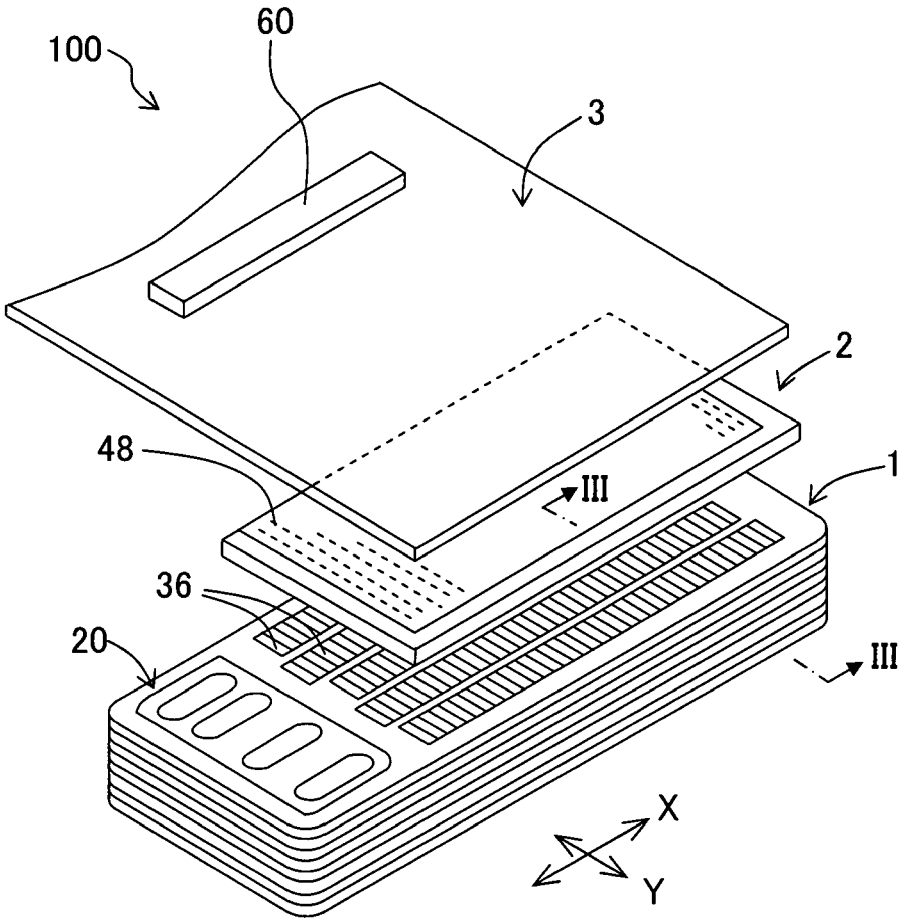
FIG. 1 is a perspective view of an ink-jet head used in an ink-droplet jetting apparatus of the present invention.
Figure 3:
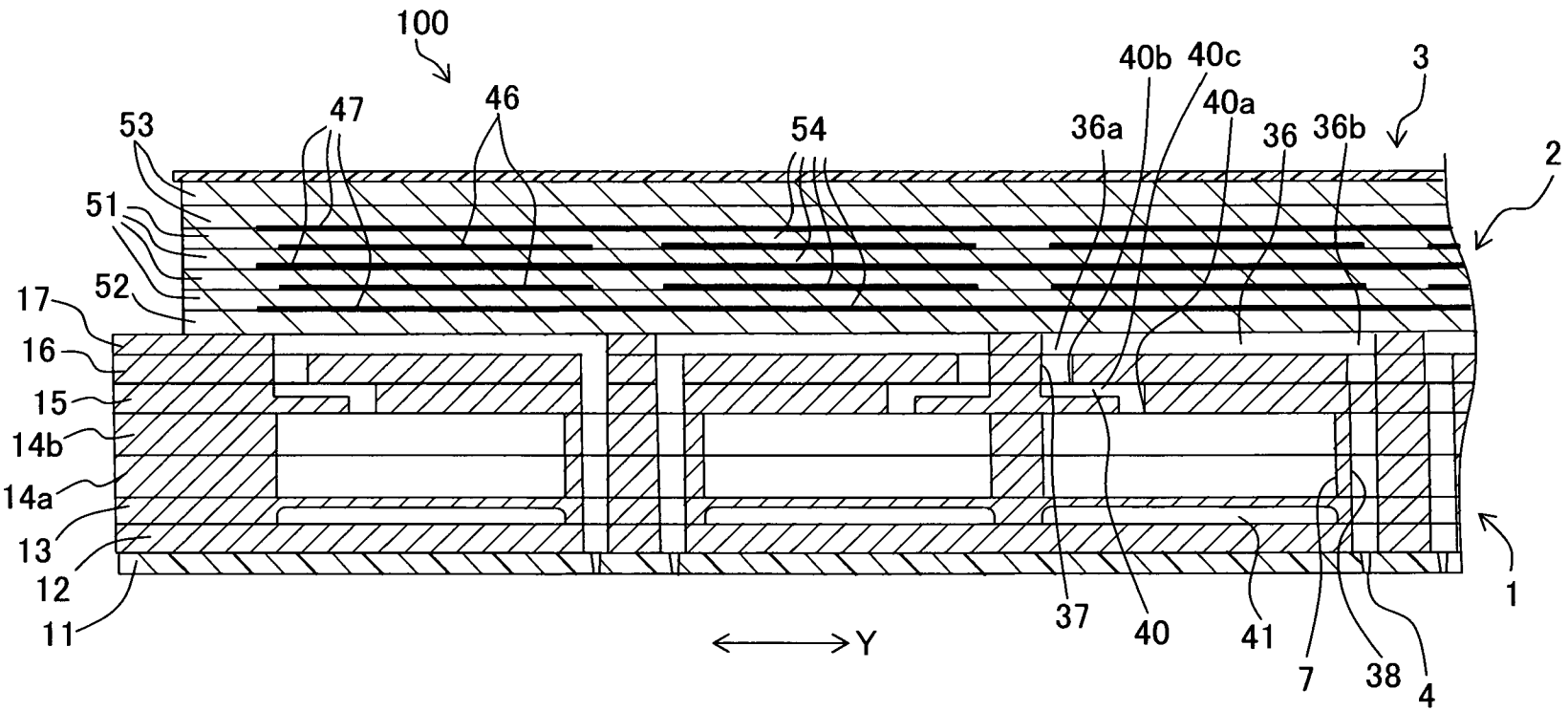
FIG. 3 is a cross-sectional view taken along a line III-III in FIG. 1.

FIG. 1 is an exploded perspective view of the ink-jet head 100 used in the ink-droplet jetting apparatus. The ink-jet head 100 includes a cavity unit 1 which includes a plurality of plates, a piezoelectric actuator 2 in the form of a plate, and a flexible flat cable 3 which connects with a control unit 200. The cavity unit 1 is connected to the piezoelectric actuator 2, the flexible flat cable 3 is joined on an upper surface of the piezoelectric actuator 2 (surface on a side opposite to the cavity unit 1). As shown in FIG. 3, the nozzles 4 are formed on a lower surface of the cavity unit 1, and the ink is jetted downward from the nozzles 4.

Figure 2:
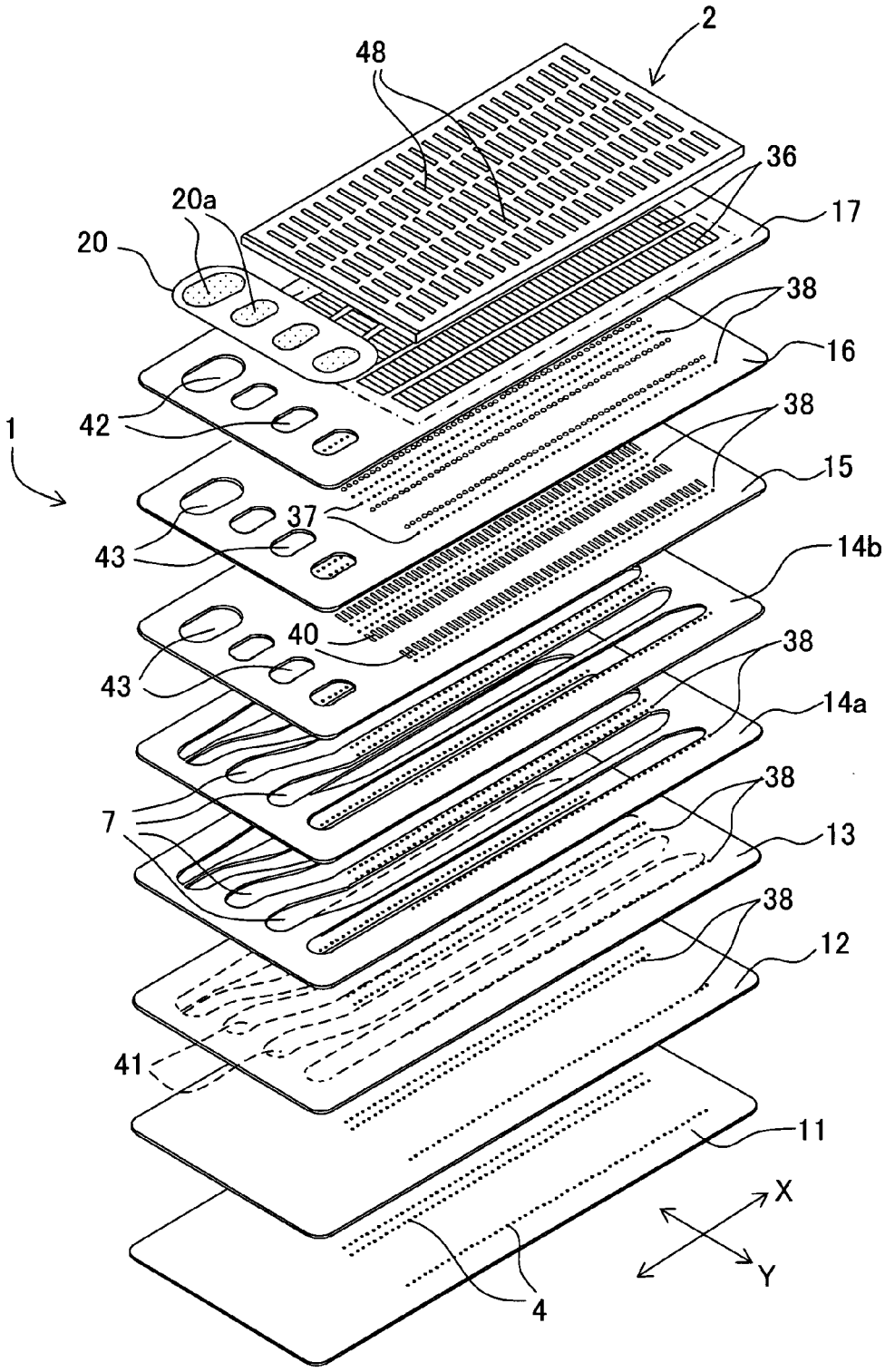
FIG. 2 is an exploded perspective view of the ink-jet head.

As shown in FIG. 2, the cavity unit includes a nozzle plate 11, a spacer plate 12, a damper plate 13, two manifold plates 14*a* and 14*b*, a supply plate 15, a base plate 16, and a cavity plate 17, and these eight thin flat plates are stacked in layers, and joined by an adhesive.

Each of the plates 11 to 17 has a thickness of about 40 μm to 150 μm. The nozzle plate 11 is made of a synthetic resin such as polyimide, and the other plates 12 to 17 are made of 42% nickel alloy steel. A plurality of nozzles 4 having a substantially small diameter (of about 20 μm) are formed at a substantially small interval in the nozzle plate 11. These nozzles 4 are arranged in five rows along a longitudinal direction (X direction) of the nozzle plate 11.

As shown in FIG. 3, the nozzle 4 is connected to a pressure chamber 36 formed in the cavity plate 17, via a through channel 38 which is formed through the spacer plate 12, the damper plate 13, the two manifold plates 14*a* and 14*b*, the supply plate 15, and the base plate 16.

As shown in FIG. 2, in the cavity plate 17, a plurality of pressure chambers 36 is arranged in five rows in a direction (X direction) parallel to a long side of the cavity plate 17. Each of the pressure chambers 36 has an elongated shape, and a longitudinal direction of each of the pressure chambers 36 is in a short side direction (Y direction) of the cavity plate 17. Each of the pressure chambers 36 is formed as a through hole in the cavity plate 17. The longitudinal direction of each of the pressure chambers 36 coincides with a direction of a flow of ink. As shown in FIG. 3, one end 36*a* in the longitudinal direction of each of the pressure chambers 36 communicates with a common ink chamber 7 via a connecting channel 40 and a communicating hole 37 which will be described later, and, the other end 36*b* in the longitudinal direction of the one of the pressure chambers 36 is connected to the through channel 38.

The connecting channel 40 which supplies the ink from the common ink chamber 7 to each of the pressure chambers 36 is formed in the supply plate 15 which is stacked on a lower surface of the cavity plate 17 via the base plate 16. As shown in FIG. 3, each of the connecting channels 40 is provided with an inlet port 40*a* through which the ink flows in from the common ink chamber 7, an outlet port 40*b* which is connected to the pressure chamber 36 via the communicating hole 37 in the base plate 16, and an aperture (throttle portion) 40*c* which is positioned between the inlet port 40*a* and the outlet port 40*b* and which has a small cross-sectional area and a maximum channel resistance in the connecting channels 40. This aperture 40*c* prevents a back flow of the ink to the common ink chamber 7 when a jetting pressure is exerted on the pressure chamber 36, and the aperture 40*c* also allows the ink to flow efficiently toward the nozzle 4 to jet the ink from the nozzle 4.

Five of common ink chambers 7, which are elongated in a longitudinal direction (X direction) of the manifold plates 14*a* and 14*b*, are formed as through holes in the two manifold plates 14*a* and 14*b*. In other words, the common ink chambers 7 are extended along each row of nozzles 4. As shown in FIG. 3, the five common ink chambers (manifold chambers) 7 are formed by stacking two manifold plates 14*a* and 14*b*, then covering an upper surface of the stacked manifold plates 14*a* and 14*b* by the supply plate 13, and covering a lower surface thereof by the damper plate 13. Each common ink chamber 7, in a plan view (viewed from a stacking direction of the plates) overlaps with a part of the pressure chamber 36, and is extended in a direction of row of the pressure chamber 36 (direction of row of nozzles 4).

As shown in FIG. 2 and FIG. 3, on a lower surface side of the damper plate 13 stacked on a lower surface of the manifold plate 14*a*, a damper chamber 41 which is isolated from the common ink chamber 7 is formed as a groove (recess). As shown in FIG. 2, a position and a shape of the damper chamber 41 coincide with a position and shape of the common ink chamber 7. A ceiling portion in the form of a thin plate on an upper portion (upper side) of the damper chamber 41 formed in the damper plate 13 is capable of free elastic vibrations both toward a common ink chamber 7 and toward the damper chamber 41. At the time of jetting of ink, even when a pressure fluctuation generated in the ink in the pressure chamber 36 is propagated to the common ink chamber 7, since the ceiling portion undergoes elastic vibrations, the damper chamber 41 functions as a damper which absorbs and attenuates the pressure fluctuation (damper effect). Consequently, it is possible to suppress a cross-talk which is a phenomenon in which the pressure fluctuation in one pressure chamber 36 is propagated to the other pressure chamber 36.

As shown in FIG. 2, four ink supply ports 42 are formed as inlets for the ink to the cavity unit 1 on an end portion on one short side of the cavity plate 17. Four connecting ports 43 overlapping with the four ink supply ports 42 respectively are formed in the base plate 16 and the supply plate 15, and the ink supplied from an ink source is supplied to one end portion in the longitudinal direction of the common ink chamber 7 via the ink supply port 42 and the connecting port 43. A filter 20 having a filter portion (filter element) 20*a* corresponding to an opening of the ink supply port 42 is stuck by an adhesive to cover the ink supply port 42.

In this embodiment, four ink supply ports 42 and four connecting ports 43 are provided, and five common ink chambers 7 are provided. The ink supply port 42 positioned at a left end in FIG. 2 supplies the ink to two common ink chambers 7. In this embodiment, taking into to consideration that a frequency of use of a black ink is higher as compared to a frequency of use of other color inks, the black ink is supplied to this ink supply port 42 which supplies the ink to the two common ink chambers 7. Inks of yellow, magenta, and cyan colors are supplied to the other ink supply ports 42.

Similarly as a hitherto known piezoelectric actuator disclosed in Japanese Patent Application Laid-open No. 2002-254634, the piezoelectric actuator 2 includes a plurality of individual electrodes 46, common electrodes 47, and ceramics layers in the form of a plate having a size to cover the pressure chambers 36 entirely, and the individual electrode 46 and the common electrode 47 are sandwiched and stacked alternately between the plurality of ceramics layers. The ceramics layers include a plurality of base piezoelectric layers 51, bottom layer 52 arranged on a lower surface of the base piezoelectric layer 51, and a top layer 53 arranged on an upper surface of the base piezoelectric layer 51. A portion of the base piezoelectric layer 51, which is sandwiched between the individual electrode 46 and the common electrode 47, is formed as an active portion 54 which is polarized in a direction facing these electrodes. A lower surface of the bottom layer 52 is fixed to the cavity plate 17 via an adhesive layer. The individual electrode 46 is formed at a position corresponding to the pressure chamber 36, and the common electrode 47 is formed to cover the plurality of pressure chambers 36. When a voltage is applied between the individual electrode 46 and the common electrode 47, a volume of the pressure chamber 36 is changed, because the ceramics layer sandwiched between the individual electrode 46 and the common electrode 47 is deformed.

A surface electrode 48 which is electrically connected to the individual electrode 46 and the common electrode 47 via a through hole is formed on an upper surface of the top layer 53, and the flexible flat cable 3 is connected to the surface electrode 48.

A structure of a control unit (signal control unit) 200 which generates a drive pulse signal to be applied to each of the electrodes will be described with reference to FIG. 4. The control unit 200 includes an LSI (large scale integration) chip 60 (refer to FIG. 1) which is arranged on the flexible flat cable 3, and the surface electrode 48 corresponding to each of the individual electrode 46 and the common electrode 47 is connected to the LSI chip 60. Moreover, a clock line 61 extending from a main body circuit not shown in the diagram, a data line 62, a piezoelectric line 63, and an earth (earthing) line 64 are connected to the LSI chip 60. Data corresponding to each of the nozzles 4 on the data line 62 is supplied serially (serial supply) in synchronization with a clock pulse supplied from the clock line 61. A plurality of driving-waveform data supplied from the main body circuit via the piezoelectric line 63 is output based on the data described above, and a drive pulse signal of a voltage value suitable for driving the active portion 54 is generated. The drive pulse signal which is generated is applied to the surface electrode 48 corresponding to a desired pressure chamber 36.

As shown in FIG. 5A, the drive pulse signal is formed by a pulse which changes between voltage values V1 and V2. In this embodiment, V1 is set to be an arbitrary positive voltage value (approximately 22 V for example) and V2 is set to be 0 V. At the time of ink jetting, the positive voltage V1 is applied to all individual electrodes 46. Since the common electrodes 47 are grounded, the active portion 54 between the individual electrode 46 and the common electrode 47 is extended, and the volume of the all the pressure chamber 36 is decreased. When a voltage application to the individual electrode 46 corresponding to the pressure chamber 36 which makes an attempt to jet the ink is stopped (switched to V2), the active portion 54 regains its contracted state, and the volume of the pressure chamber 36 is increased. As the volume of the pressure chamber 36 is increased, the pressure on the ink in the pressure chamber 36 is decreased, and a pressure wave of a negative pressure is generated. When the voltage is applied again to the individual electrode 46 at a timing when the pressure of the pressure wave is changed to a positive pressure, a pressure due to the elongation of the active portion, and the pressure changed to the positive pressure are superimposed. Due to the superimposed pressures, an ink droplet is jetted from the nozzle 4.

As it has been described above, the pulse changes between the voltages V1 and V2 set in advance. Practically, as shown in FIG. 5B, a delay time is generated in a rise and a fall of the waveform. This is because, since the piezoelectric layer sandwiched between the individual electrode 46 and the common electrode 47 acts as a condenser (C), and there is a resistance (R) in a path from the control unit 200 which outputs the drive pulse signal up to the individual electrode 46, an integrating circuit is formed by the C and R. For example, even when the control circuit 200 outputs a rectangular wave as a drive pulse signal, there is a delay in the rise and the fall of the pulse in the individual electrode 46. It is possible to make the voltage to be applied to the piezoelectric actuator 2 to reach from the voltage V1 to the voltage V2 by setting a pulse width Tm of a pulse Pm to be sufficiently long taking into consideration the delay. On the other hand, it is possible to adjust the voltage applied to the piezoelectric actuator 2 between the voltage V1 and the voltage V2 by setting a pulse width Ts of the pulse Ps to be short. In other words, it is possible to make small a change in the voltage applied to the piezoelectric actuator 2.

However, contrary to the description above, as in an actuator disclosed in Japanese Patent Application Laid-open No. 2001-301161, an arrangement may be such that the volume of the pressure chamber 36 is increased and a pressure wave is generated by applying a voltage to a drive electrode, and the volume of the pressure chamber 36 is decreased and an ink droplet is jetted by stopping applying the voltage at a point of time at which the pressure wave has changed.

In this ink-droplet jetting apparatus, since a gradation (a half-tone) in which, a diameter of a dot formed on a recording medium is changed is carried out, a plurality of drive pulse signals are set in advance according to a volume of ink per dot. The drive pulse signal which forms one dot includes a plurality of main pulses which jets an ink droplet, and a regulating pulse which is inserted between two main pulses, and suppresses the residual vibration generated due to a previous main pulse. As it has been described in FIG. 5A and FIG. 5B, the main pulse and the regulating pulse increase the volume of the respective pressure chamber 36, and then decrease the volume thereof, by driving the piezoelectric actuator 2. The ink droplet is not jetted by the regulating pulse.

Figure 6:
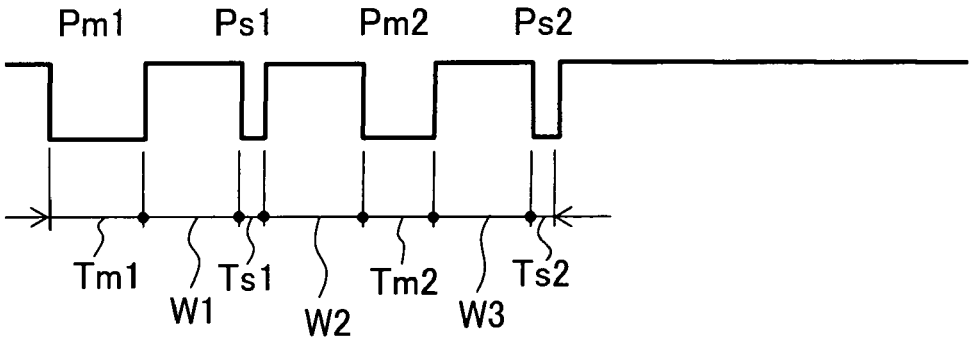
FIG. 6 is a schematic diagram showing a drive pulse signal which includes four pulses.

As a drive pulse signal which jets a plurality of ink droplets, a drive pulse signal which includes two main pulses as shown in FIG. 6 was examined. The drive pulse signal shown in FIG. 6 includes a first main pulse Pm1, a first regulating pulse Ps1, a second main pulse Ps2, and a second regulating pulse Ps2 (four-pulse waveform), and these four pulses are applied in the abovementioned order.

Results of experiments carried out by inventors of the present invention are shown in FIG. 7. The inventors of the present invention carried out the experiments by letting a pulse width of the first main pulse Pm1 to be Tm1, a pulse width of the first regulating pulse Ps1 to be Ts1, a pulse width of the second main pulse Pm2 to be Tm2, a pulse width of the second regulating pulse Ps2 to be Ts2, an interval between a tail end (a trailing edge) of the first main pulse Pm1 and a head end (a leading edge) of the first regulating pulse Ps1 to be W1 (first interval), an interval between a tail end of the first regulating pulse Ps1 and a head end of the second pulse Pm2 to be W2 (second interval), and an interval between a tail end of the second main pulse Pm2 and a head end of the second regulating pulse Ps2 to be W3, and taking these values (unit: μsec) as parameters. At this time, a series of pulses shown in FIG. 6 was let to be one set, and a stability when this set of pulses was driven continuously over a plurality of cycles at a drive frequency of 13 kHz, and a stability when an ink droplet was jetted when this set of pulses was driven after every one cycle, or after every two cycles was examined.

In FIG. 7, the 'stability' was determined by observing whether a splash or ink mist was generated in a jetting state. A state of the maximum stability in which, an effect of the residual vibration even when jetted continuously was suppressed and there was no splash or ink mist was determined to be '+', a state in which the stability was somewhat declined compared to the stability in the state of the maximum stability, but there was no problem practically was determined to be '±', and a state in which the stability was declined, and was not practical was determined to be '−'.

It is possible to express the pulse width and the interval by using a time AL in which the pressure wave generated in the ink in the ink channel including the pressure chamber 36 is propagated one-way in a longitudinal direction in the ink channel (in other words, ½ of a cycle of the pressure fluctuation of the ink), due to the change in the volume of the pressure chamber 36. An ink-jet head 100 having AL=4 μsec was used for the abovementioned experiments. From the results of the experiments, it is possible to indicate an appropriate practical range by using the AL as follows. Here, the appropriate practical range is determined by taking a margin or the like into consideration.

$0.8\ AL \leqq Tm1 \leqq 1.3\ AL$ (3.2 μsec≦Tm1≦5.2 μsec)
$2.0\ AL \leqq W1 \leqq 3.0\ AL$ (8.0 μsec≦W1≦12.0 μsec)
$0.1\ AL \leqq Ts1 \leqq 0.4\ AL$ (0.4 μsec≦Ts1≦1.6 μsec)
$3.0\ AL \leqq W2 \leqq 6.0\ AL$ (12.0 μsec≦W2≦24.0 μsec)
$0.8\ AL \leqq Tm2 \leqq 1.3\ AL$ (3.2 μsec≦Tm2≦5.2 μsec)
$2.0\ AL \leqq W3 \leqq 3.0\ AL$ (8.0 μsec≦W3≦12.0 μsec) and
$0.1\ AL \leqq Ts2 \leqq 0.4\ AL$ (0.4 μsec≦Ts2≦1.6 μsec)

Figures 8, 9:
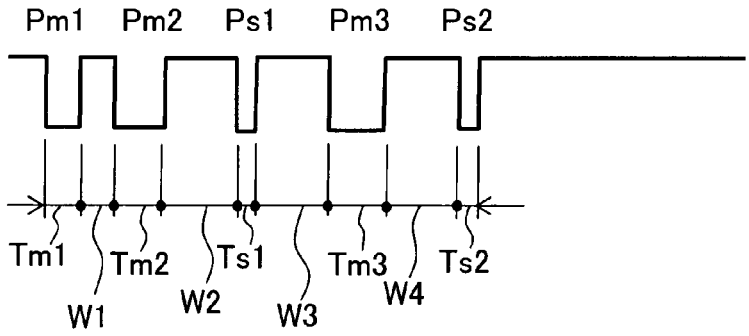
FIG. 8 is a table showing other experiment results of the drive pulse signal which includes four pulses.
FIG. 9 is a schematic diagram showing a drive pulse signal which includes five pulses.

When the inventors of the present patent application carried out experiments based on the experiment results shown in FIG. 7, it was revealed that even more preferable results are achieved by drive pulse signals shown by A to G in FIG. 8. The range shown below is a range, in which the appropriate practical range derived based on the results of A to G in FIG. 8 is indicated by using the one-way propagation time AL (AL=4 μsec).

$1.05\ AL \leqq Tm1 \leqq 1.25\ AL$ (4.2 μsec≦Tm1≦5.0 μsec)
$2.25\ AL \leqq W1 \leqq 2.9\ AL$ (9.0 μsec≦W1≦11.6 μsec)
$0.1\ AL \leqq Ts1 \leqq 0.4\ AL$ (0.4 μsec≦Ts1≦1.6 μsec)
$5.0\ AL \leqq W2 \leqq 5.4\ AL$ (20 μsec≦W2≦21.6 μsec)
$1.05\ AL \leqq Tm2 \leqq 1.25\ AL$ (4.2 μsec≦Tm2≦5.0 μsec)
$2.25\ AL \leqq W3 \leqq 2.75\ AL$ (9.0 μsec≦W3≦11.0 μsec) and
$0.1\ AL \leqq Ts2 \leqq 0.4\ AL$ (0.4 μsec≦Ts2≦1.6 μsec).

It was revealed that favorable results can be obtained by setting the interval W2 (second interval) to be same as or longer than the interval W1 (first interval). The interval W2 means an interval between the first regulating pulse Ps1 and the second main pulse Pm2 immediately after the first regulating pulse Ps1, and the interval W1 means an interval between the first regulating pulse Ps1 and the first main pulse Pm1 immediately before the first regulating pulse Ps1. Moreover, it was also revealed that it is possible to suppress effectively the residual vibration due to the main pulse by making long a width of the entire set of pulses by adjusting the voltage applied to the piezoelectric actuator to a low voltage between the voltage V1 and the voltage V2 by making the pulse width of the first regulating pulse Ps1 and the second regulating pulse Ps2 short.

A drive pulse signal which includes three main pulses as shown in FIG. 9 was examined as a drive pulse signal which jets a plurality of ink droplets. The drive pulse signal shown in FIG. 9 includes five pulses namely the first main pulse Pm1, the second main pulse Pm2, the first regulating pulse Ps1, a third main pulse Pm3, and a second regulating pulse Ps2 (five-pulse waveform), and these pulses are applied in the abovementioned order (time series)

Results of experiments carried out by the inventors of the present invention are shown in FIG. 10. The inventors carried out the experiments by letting the pulse width of the first main pulse Pm1 to be Tm1, the pulse width of the second main pulse Pm2 to be Tm2, the pulse width of the first regulating pulse Ps1 to be Ts1, a pulse width of the third main pulse Pm3 to be Tm3, the pulse width of the second regulating pulse Ps2 to be Ts2, an interval between the tail end of the previous pulse and the head end of the subsequent pulse for a pair of these pulses to be W1, W2 (first interval), W3 (second interval), and W4 respectively, and taking these as parameters (unit: μsec). An evaluation standard for the 'stability' in the diagram is same as an evaluation standard in FIG. 7. From the results of the experiments, it is possible to indicate the appropriate practical range by using the one-way propagation time AL (AL=4 μsec) as follows.

0.6 AL≦Tm1≦1.2 AL (2.4 μsec≦Tm1≦4.8 μsec),
1.0 AL≦W1≦1.8 AL (4.0 μsec≦W1≦7.2 μsec),
0.7 AL≦Tm2≦1.45 AL (2.8 μsec≦Tm2≦5.8 μsec),
1.5 AL≦W2≦3.0 AL (6.0 μsec≦W2≦12.0 μsec),
0.15 AL≦Ts1≦0.3 AL (0.6 μsec≦Ts1≦1.2 μsec),
1.5 AL≦W3≦6.0 AL (6.0 μsec≦W3≦24.0 μsec),
0.7 AL≦Tm3≦1.4 AL (2.8 μsec≦Tm3≦5.6 μsec),
0.5 AL≦W4≦1.0 AL (2.0 μsec≦W4≦4.0 μsec), and
0.15 AL≦Ts2≦0.38 AL (0.6 μsec≦Ts2≦1.5 μsec).

Figures 11, 12:
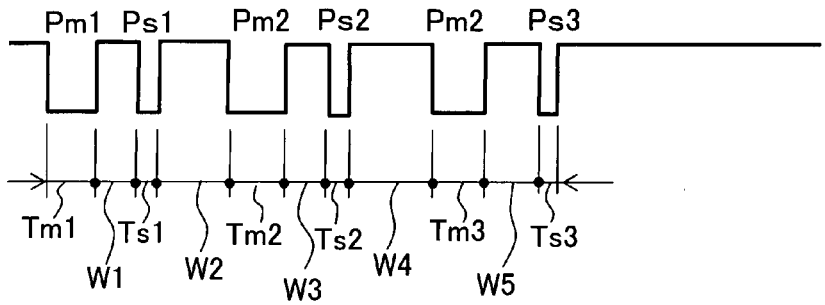
FIG. 11 is a table showing other experiment results of the drive pulse signal which includes five pulses.
FIG. 12 is a schematic diagram showing a drive pulse signal which includes six pulses.

When the inventors of the present invention carried out further experiments based on the experiment results shown in FIG. 10, it was revealed that even more preferable results can be obtained by drive pulse signals shown by A to J in FIG. 11. The range shown below is range in which the appropriate practical range derived based on the results of A to J in FIG. 11 is indicated by using the one-way propagation time AL (AL=4 μsec).

0.6 AL≦Tm1≦0.85 AL (2.4 μsec≦Tm1≦3.4 μsec),
1.2 AL≦W1≦1.58 AL (4.8 μsec≦W1≦6.3 μsec),
0.88 AL≦Tm2≦1.25 AL (3.5 μsec≦Tm2≦5.0 μsec),
2.25 AL≦W2≦2.38 AL (9.0 μsec≦W2≦9.5 μsec),
0.2 AL≦Ts1≦0.3 AL (0.8 μsec≦Ts1≦1.2 μsec),
1.88 AL≦W3≦5.75 AL (7.5 μsec≦W3≦23.0 μsec),
0.7 AL≦Tm3≦1.13 AL (2.8 μsec≦Tm3≦4.5 μsec),
0.63 AL≦W4≦0.75 AL (2.5 μsec≦W4≦3.0 μsec), and
0.25 AL≦Ts2≦0.38 AL (1.0 μsec≦Ts2≦1.5 μsec).

It was revealed that even in the drive pulse signal which includes five pulses (five-pulse waveform), favorable results can be obtained by setting the interval W3 (second interval) to be almost same as or longer than the interval W2 (first interval). The interval W3 means an interval between the first regulating pulse Ps1 and the third main pulse Ps3 immediately after the first regulating pulse Ps1, and the interval W2 means an interval between the first regulating pulse Ps1 and the second main pulse Pm2 immediately before the first regulating pulse Ps1. It was also revealed that it is possible to suppress effectively the residual vibration caused due to the main pulse, without making long a width of the entire set of pulses, by setting a width of the first regulating pulse Ps1 and the second regulating pulse Ps2 to a short time in which the voltage applied to the piezoelectric actuator does not reach V2, similarly as in the regulating pulse Ps in FIG. 5B.

Another example of a drive pulse signal which includes three main pulses as shown in FIG. 12 was examined as a drive pulse signal which jets a plurality of ink droplets. The drive pulse signal shown in FIG. 12 includes six pulses namely the first main pulse Pm1, the first regulating pulse Ps1, the second main pulse Pm2, the second regulating pulse Ps2, the third main pulse Pm3, and a third regulating pulse Ps3 (six-pulse waveform), and these six pulses are applied in the abovementioned order.

Results of experiments carried out by the inventors of the present invention are shown in FIG. 13. The inventors carried out the experiments by letting the pulse width of the first main pulse Pm1 to be Tm1, the pulse width of the first regulating pulse Ps1 to be Ts1, the pulse width of the second main pulse Pm2 to be Tm2, the pulse width of the second regulating pulse Ps2 to be Ts2, the pulse width of the third main pulse Pm3 to be Tm3, a pulse width of the third regulating pulse Ps3 to be Ts3, interval between the tail end of the previous pulse and the head end of the subsequent pulse for a pair of these pulses to be W1 (first interval), W2 (second interval), W3, W4, and W5, and taking these as parameters (unit: μsec). An evaluation standard for the 'stability' in the diagram is same as the evaluation standard in FIG. 7. From the results of the experiments, it is possible to indicate the appropriate practical range by using the one-way propagation time AL (AL=4 μsec) as follows.

0.8 AL≦Tm1≦1.3 AL (3.2 μsec≦Tm1≦5.2 μsec),
0.7 AL≦W1≦1.2 AL (2.8 μsec≦W1≦4.8 μsec),
0.15 AL≦Ts1≦0.3 AL (0.6 μsec≦Ts1≦1.2 μsec),
4.5 AL≦W2≦6.5 AL (18.0 μsec≦W2≦26.0 μsec),
0.8 AL≦Tm2≦1.3 AL (3.2 μsec≦Tm2≦5.2 μsec),
0.7 AL≦W3≦1.2 AL (2.8 μsec≦W3≦4.8 μsec),
0.15 AL≦Ts2≦0.3 AL (0.6 μsec≦Ts2≦1.2 μsec),
4.5 AL≦W4≦6.5 AL (18.0 μsec≦W4≦26.0 μsec),
0.8 AL≦Tm3≦1.3 AL (3.2 μsec≦Tm3≦5.2 μsec),
0.7 AL≦W5≦1.2 AL (2.8 μsec≦W5≦4.8 μsec), and
0.15 AL≦Ts3≦0.3 AL (0.6 μsec≦Ts3≦1.2 μsec)

When the inventors of the present invention carried out further experiments based on the experiment results in FIG. 13, it was revealed that even more preferable results can be obtained by drive pulse signals of A to K in FIG. 14. The range shown below is a range in which the appropriate practical range derived based on the results of A to K in FIG. 14 is indicated by using the one-way propagation time AL (AL=4 μsec).

1.0 AL≦Tm1≦1.25 AL (4.0 μsec≦Tm1≦5.0 μsec),
0.85 AL≦W1≦1.0 AL (3.4 μsec≦W1≦4.0 μsec),
0.15 AL≦Ts1≦0.3 AL (0.6 μsec≦Ts1≦1.2 μsec),
4.75 AL≦W2≦5.75 AL (19.0 μsec≦W2≦23.0 μsec),
1.0 AL≦Tm2≦1.25 AL (4.0 μsec≦Tm2≦5.0 μsec),
0.85 AL≦W3≦1.0 AL (3.4 μsec≦W3≦4.0 μsec),
0.15 AL≦Ts2≦0.3 AL (0.6 μsec≦Ts2≦1.2 μsec),
4.75 AL≦W4≦5.75 AL (19.0 μsec≦W4≦23.0 μsec),
1.0 AL≦Tm3≦1.25 AL (4.0 μsec≦Tm3≦5.0 μsec),
0.85 AL≦W5≦1.0 AL (3.4 μsec≦W5≦4.0 μsec), and
0.15 AL≦Ts3≦0.3 AL (0.6 μsec≦Ts3≦1.2 μsec), It was revealed that even in the drive pulse signal which includes six pulses (six-pulse waveform), favorable results can be obtained by setting the interval W2 (second interval) to be longer than the interval W1 (first interval). The interval W2 means an interval between the first regulating pulse Ps1 and the second main pulse Pm2 immediately after the first regulating pulse Ps1, and the interval W1 means an interval between the first regulating pulse Ps1 and the first main pulse Pm1 immediately before the first regulating pulse Ps1. It was also revealed that it is possible to suppress effectively the residual vibration due to the main pulse, without making long a width of the entire set of pulse, by setting a width of the first regulating pulse Ps1, the second regulating pulse Ps2, and the third regulating pulse Ps3 to a short time in which the voltage applied to the piezoelectric actuator 2 does not reach V2.

As it has been described above, in a drive pulse signal which includes two main pulses (four-pulse waveform), and two types of drive pulse signal which include three main pulses (five-pulse waveform and six-pulse waveform), as drive pulse signals which form one dot by jetting a plurality of ink droplets, in an arrangement in which the regulating pulse is applied to the main pulse, by making the interval (second interval) between the first regulating pulse and the main pulse immediately after the first regulating pulse to be almost same as or longer than the interval (first interval) between the first regulating pulse and the main pulse immediately before the first regulating pulse, it was possible to suppress promptly and effectively the complex residual vibration due to the main pulse, and to jet the ink droplets stably.

Moreover, it is possible to make short the width of the drive pulse signal (entire set of pulses), to increase the drive frequency, and to increase the recording speed by setting the pulse width of the regulating pulse to be short such that the voltage applied to the piezoelectric actuator does not reach from one voltage value to the other voltage value. Moreover, it is possible to suppress a fatigue and a heat generation in the piezoelectric actuator by making the pulse width short. Therefore, it is possible to carry out a high quality recording by operating stably over a long period of time.

As another embodiment, an ink-droplet jetting apparatus in which a plurality of drive pulse signals which form one dot by jetting a plurality of ink droplets is provided, and which selects one of a drive pulse signal which is accommodated in one jetting cycle and a drive pulse signal which covers two jetting cycles, according to dot information which is to be recorded.

Generally, at the time of jetting ink droplets, when a drive pulse signal does not have a regulating pulse (canceling pulse), which suppresses the residual vibration (residual pressure vibration), after a main pulse which jets the ink droplet, or when the drive pulse signal has a regulating pulse, but an effect of the regulating pulse is weak, not only that the jetting of the subsequent dot is uncertain, but also an unnecessary ink droplet called as a 'satellite' apart form the ink droplet to be jetted originally, may be generated. When this 'satellite' lands on a recording medium, an image quality of characters or the like printed on the recording medium is declined. However, when a dot is required to be formed in continuation during an adjacent jetting cycle, a dot adjacent to the earlier dot is formed on the recording medium. In other words, since the subsequent dot is formed overlapping with the satellite, even though the satellite is generated in the previous jetting cycle, an effect of the satellite is hardly remarkable.

On the other hand, as in the four-pulse wave form, the five-pulse waveform, and the six-pulse waveform optimized in the embodiment described above, when the generation of the satellite is eliminated by suppressing the residual vibration, the length of the entire drive pulse signal becomes long. When the jetting cycle is set according to the length of the drive pulse signal, the drive frequency is declined. Therefore, an arrangement is made such that such long drive pulse signal is spread over two jetting cycles. In this embodiment, the drive pulse signal includes a first drive pulse signal which is accommodated in one jetting cycle, and a second drive pulse signal which is spread over two jetting cycles, and a method in which one of the first drive pulse signal and the second drive pulse signal is selected according to dot information of whether or not it is necessary to jet continuously a dot in an adjacent jetting cycle, is adopted.

Figure 15:
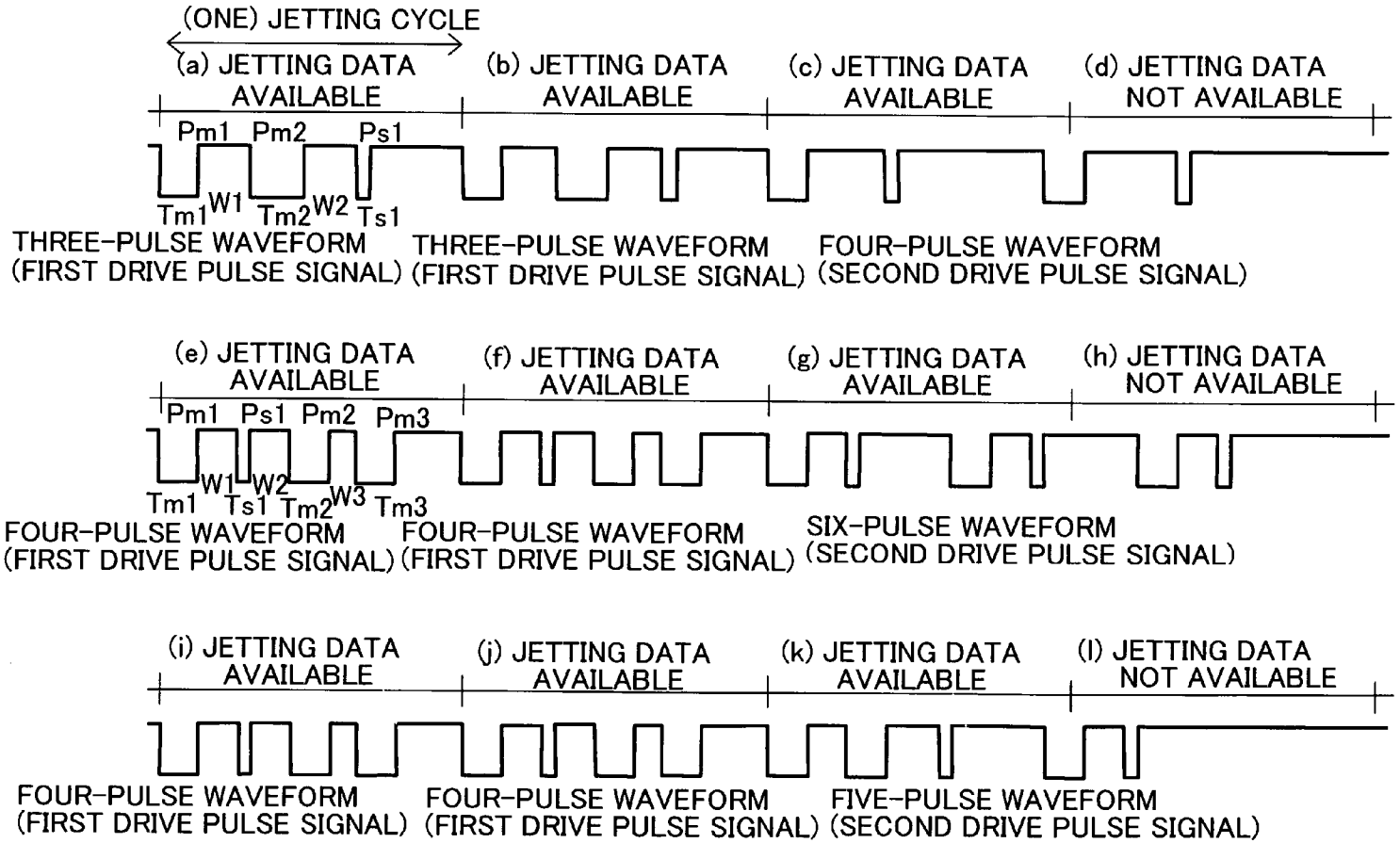
FIG. 15 is a diagram showing a selected example of a drive pulse signal based on dot information.

As a first drive pulse signal having a plurality of pulses for jetting a plurality of ink droplets in one jetting cycle, a drive pulse signal which includes two main pulses (three-pulse waveform) as shown in (a) in FIG. 15, FIG. 16, and FIG. 17, and a drive pulse signal which includes three main pulses (four-pulse waveform) as shown in (e) in FIG. 15, FIG. 18, and FIG. 19 are taken into consideration. Details of these drive pulse signals will be described later.

Moreover, as a second drive pulse signal ranging the adjacent jetting cycle and having a plurality of pulses for jetting a plurality of ink droplets, a drive pulse signal which includes two main pulses (four-pulse waveform, refer to FIG. 6 to FIG. 8), for which an optimum range was derived in the embodiment described above, and a drive pulse signal which includes three main pulses (five-pulse waveform, refer to FIG. 9 to FIG. 11), and a drive pulse signal which includes three main pulses (six-pulse waveform, refer to FIG. 12 to FIG. 14) are taken into consideration.

Figure 20:
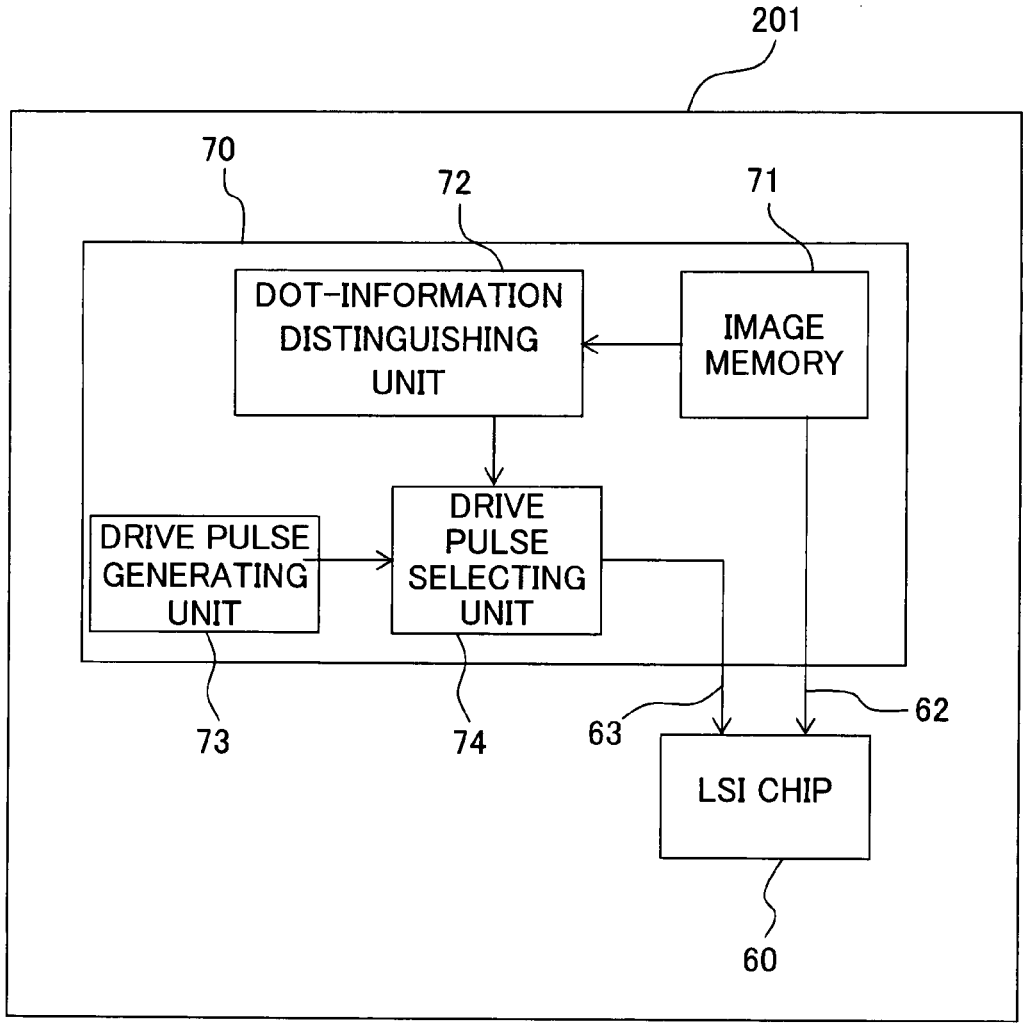
FIG. 20 is a block diagram of another portion of a control unit.

As shown in FIG. 20, in this embodiment, a main body circuit 70 in a control unit (signal control unit) 201 includes an image memory 71 which stores dot information to be recorded which is input from an outside, a dot-information distinguishing unit 72 which determines a liquid-droplet volume of one dot to be jetted in the current jetting cycle based on the dot information in the image memory 71 and which judges whether it is dot information to be jetted in the current jetting cycle and the subsequent jetting cycle, a drive pulse generating unit 73 which generates the first drive pulse signal and the second drive pulse signal, and a drive pulse selecting unit 74 which selects the drive pulse based on output information of (from) the dot-information distinguishing unit 72, and outputs to the LSI chip 60 of the piezoelectric actuator 2 (refer to FIG. 4).

In the main body circuit 70, data of the dot information from the image memory 71 is supplied to the data line 62 of the LSI chip 60. When the data of the dot information of one dot indicates a comparatively small liquid-droplet volume, driving waveform data corresponding to the drive pulse signal which jets two droplets (three-pulse waveform in (a) in FIG. 15 or four-pulse waveform in FIG. 6) is selected, and when the data of the dot information indicates a comparatively large liquid-droplet volume, driving waveform data of the drive pulse signal which jets three droplets (four-pulse waveform in (e) in FIG. 15, and five-pulse waveform in FIG. 9 or six-pulse waveform in FIG. 12) is selected, and is supplied to the piezoelectric line 63.

In the drive-pulse selecting unit 74, when the dot information of the current jetting cycle is 'jetting' and the dot information of the subsequent jetting cycle is also 'jetting', the first drive pulse signal corresponding to a liquid-droplet volume indicated by the data of dot information (three-pulse waveform in (a) in FIG. 15 or four-pulse waveform in (e) in FIG. 15) is selected. Moreover, when the dot information of the current jetting cycle is 'jetting', and the dot information of the subsequent jetting cycle is 'no jetting', the second drive pulse signal corresponding to a volume indicated by the data of dot information (four-pulse waveform in FIG. 6, five-pulse waveform in FIG. 9, or six-pulse waveform in FIG. 12) is selected.

As shown in (a) in FIG. 15, the three-pulse waveform included in the first drive pulse signal includes three pulses namely the first main pulse Pm1 (pulse width Tm1), the second main pulse Pm2 (pulse width Tm2), and the first regulating pulse Ps1 (pulse width Ts1), in the abovementioned order. An interval between the tail end of the previous pulse and the head end of the subsequent pulse is let to be W1 and W2 respectively. Letting these pulse widths (Tm1, Tm2, and Ts1), and the intervals (W1 and W2) as parameters, and this series of pulse as one set, experiments of driving continuously over a plurality of cycles were carried out at a drive frequency of 26 kHz. The 'stability' was evaluated similarly as in FIG. 7. The results of these experiments are shown in FIG. 16. From these results, it is possible to indicate the appropriate practical range by using the one-way propagation time AL (AL=4 μsec) as follows.

0.6 AL≦Tm1≦1.3 AL (2.4 μsec≦Tm1≦5.2 μsec),
1.7 AL≦W1≦2.8 AL (6.8 μsec≦W1≦11.2 μsec),
0.5 AL≦Tm2≦1.6 AL (2.0 μsec≦Tm2≦6.4 μsec),
1.0 AL≦W2≦2.5 AL (4.0 μsec≦W2≦10.0 μsec), and
0.1 AL≦Ts1≦0.8 AL (0.4 μsec≦Ts1≦3.2 μsec).

When the inventors of the present invention carried out experiments based on the experiment results shown in FIG. 16, it was revealed that even more preferable results are achieved by drive pulse signals shown by A to I in FIG. 17. The range shown below is a range in which, the appropriate practical range derived based on the results of A to I is indicated by using the one-way propagation time AL (AL=4 μsec).

1.0 AL≦Tm1≦1.15 AL (4.0 μsec≦Tm1≦4.6 μsec),
2.0 AL≦W1≦2.6 AL (8.0 μsec≦W1≦10.4 μsec),
1.25 AL≦Tm2≦1.4 AL (5.0 μsec≦Tm2≦5.6 μsec),
1.1 AL≦W2≦2.4 AL (4.4 μsec≦W2≦9.6 μsec), and
0.15 AL≦Ts1≦0.35 AL (0.6 μsec≦Ts1≦1.4 μsec).

Experiment results of optimization performed for the drive pulse signal (four-pulse waveform) including three main pulses, as the first drive pulse signal will be described below.

As shown in (e) in FIG. 15, the four-pulse waveform which is included in the first drive pulse signal was applied in an order of the first main pulse Pm1 (pulse width Tm1), the first regulating pulse Ps1 (pulse width Ts1), the second main pulse Pm2 (pulse width Tm2), and the third main pulse Pm3 (pulse width Tm3). The interval between the tail end of the previous pulse and the head end of the subsequent pulse in pair of pulses is let to be W1, W2, and W3 respectively. With these pulse widths (Tm1, Ts1, Tm2, and Tm3), and the intervals (W1, W2, and W3) as parameters, the inventors carried out experiments for evaluating the stability. The 'stability' was evaluated similarly as the experiment shown in FIG. 7. The results are shown in FIG. 18. As a result of these experiments, it is possible to indicate the appropriate practical range by using the one-way propagation time AL (AL=4 μsec) as follows.

0.7 AL≦Tm1≦1.3 AL (2.8 μsec≦Tm1≦5.2 μsec),
0.8 AL≦W1≦2.2 AL (3.2 μsec≦W1≦8.8 μsec),
0.15 AL≦Ts1≦0.4 AL (0.6 μsec≦Ts1≦1.6 μsec),
0.8 AL≦W2≦1.8 AL (3.2 μsec≦W2≦7.2 μsec),
0.4 AL≦Tm2≦0.8 AL (1.6 μsec≦Tm2≦3.2 μsec),
0.8 AL≦W3≦1.4 AL (3.2 μsec≦W3≦5.6 μsec), and
0.5 AL≦Tm3≦1.0 AL (2.0 μsec≦Tm3≦4.0 μsec).

When the inventors of the present invention carried out experiments based on the experiment results shown in FIG. 18, it was revealed that even more preferable results can be obtained by drive pulse signals shown by A to E in FIG. 19. The range shown below is a range in which, the appropriate practical range derived based on the results of A to E is indicated by using the one-way propagation time AL (AL=4 μsec).

0.9 AL≦Tm1≦1.05 AL (3.6 μsec≦Tm1≦4.2 μsec),
1.0 AL≦W1≦2.0 AL (4.0 μsec≦W1≦8.0 μsec),
0.2 AL≦Ts1≦0.35 AL (0.8 μsec≦Ts1≦1.4 μsec),
1.0 AL≦W2≦1.5 AL (4.0 μsec≦W2≦6.0 μsec),
0.5 AL≦Tm2≦0.75 AL (2.0 μsec≦Tm2≦3.0 μsec),
0.95 AL≦W3≦1.1 AL (3.8 μsec≦W3≦4.4 μsec), and
0.65 AL≦Tm3≦0.8 AL (2.6 μsec≦Tm3≦3.2 μsec)

When the inventors of the present invention carried out experiments based on the experiment results shown in FIG. 18, it was revealed that even more preferable results can be obtained by drive pulse signals shown by F to I in FIG. 19. An optimum range different from the abovementioned range, derived based on the results of F to I in FIG. 19 is shown below by using the one-way propagation time AL.

0.95 AL≦Tm1≦1.25 AL (3.8 μsec≦Tm1≦5.0 μsec),
1.0 AL≦W1≦1.25 AL (4.0 μsec≦W1≦5.0 μsec),
1.7 AL≦Ts1≦1.88 AL (6.8 μsec≦Ts1≦7.5 μsec),
0.87 AL≦W2≦1.13 AL (3.48 μsec≦W2≦4.5 μsec),
0.5 AL≦Tm2≦0.88 AL (2.0 μsec≦Tm2≦3.5 μsec),
1.12 AL≦W3≦1.38 AL (4.48 μsec≦W3≦5.5 μsec), and
0.75 AL≦Tm3≦0.88 AL (3.0 μsec≦Tm3≦3.5 μsec)

In this manner, based on the dot information, the optimum drive pulse signal is selected from the second drive pulse signal (four-pulse waveform, five-pulse waveform, and six-pulse waveform) and the first drive pulse signal (three-pulse waveform and four pulse waveform) provided in the respective optimum range.

When the dot information indicates a dot of a comparatively small liquid-droplet volume, and when the dot information of the current jetting cycle is 'jetting', and the dot information of the subsequent jetting cycle is also 'jetting', the drive pulse signal of the three-pulse waveform which jets two droplets (FIG. 16 and FIG. 17) is output in each cycle in (a) and (b) in FIG. 15. However, when the dot information of the current jetting cycle is 'jetting', and the dot information of the subsequent jetting cycle is 'no jetting', the drive pulse signal of the four-pulse waveform which jets two droplets (FIG. 6 to FIG. 8) is output in two cycles of (c) and (d) in FIG. 15.

When the dot information indicates a dot of a comparatively large liquid-droplet volume, and when the dot information of the current jetting cycle is 'jetting', and the dot information of the subsequent jetting cycle is also 'jetting', the drive pulse signal of the four-pulse waveform which jets three droplets (FIG. 18 and FIG. 19) is output in each cycle in (e) and (f) in FIG. 15. However, when the dot information of the subsequent jetting cycle is 'no jetting', the drive pulse signal of the six-pulse waveform which jets three droplets (FIG. 12 to FIG. 14) is output in two cycles of (g) and (h) in FIG. 15.

Since the drive pulse signal of the five-pulse waveform is also a signal which jets three droplets, it can be used instead of the drive pulse signal of the six-pulse waveform as shown in (k) and (l) in FIG. 15. In (i) and (j) in FIG. 15, the drive pulse signal of the four-pulse waveform same as in (e) and (f) in FIG. 15 is used.

The four-pulse waveform (FIG. 6 to FIG. 8), the five-pulse waveform (FIG. 9 to FIG. 11), and the six-pulse waveform (FIG. 12 to FIG. 14) included in the second drive pulse signal are waveforms which include a plurality of main pulses for jetting a plurality of ink droplets, and in which the regulating pulse and the pulse interval is set for suppressing sufficiently the complex residual pressure vibration. Therefore the overall length of the drive pulse signal is long. However, as in this embodiment, when the dot information of the current jetting cycle is 'jetting' and the dot information of the subsequent jetting cycle is 'no jetting', since the second drive pulse signal is selected, and the second drive pulse signal is used upon spreading over two jetting cycles. Therefore, it is possible to use without causing a decline in the drive frequency of the first drive pulse signal. Moreover, when the dot information of the subsequent jetting cycle is 'no jetting', it is possible to prevent the generation of the satellite, and to perform high quality printing.

The drive pulse signal which is included in the first drive pulse signal and the second drive pulse signal is not restricted to the signals mentioned above. The drive pulse signal may include pulse signals having different number of main pulses and/or pulse signals having different number of pulses, as the first drive pulse signal and the second drive pulse signal. Moreover, the number of pulses included in the drive pulse signals is not restricted to even number, and may be an odd number.

What is claimed is:

1. An ink-droplet jetting apparatus which forms one dot by jetting a plurality of droplets of an ink on to a recording medium, comprising:

a pressure chamber in which the ink is filled;

an ink channel which communicates with the pressure chamber and which is elongated in a predetermined direction;

an actuator which faces the pressure chamber, and which changes a volume of the pressure chamber to jet the droplets of the ink; and a signal control unit which supplies a drive pulse signal for driving the actuator to form the one dot, the drive pulse signal including: a first main pulse for a jetting operation; a first regulating pulse for suppressing a residual vibration of the ink in the pressure chamber caused by the first main pulse, the first regulating pulse being inserted at a first interval from the first main pulse; a second main pulse for the jetting operation, the second main pulse being inserted at a second interval from the first regulating pulse; and a second regulating pulse for suppressing a residual vibration of the ink in the pressure chamber caused by the second main pulse, the second regulating pulse being supplied after the second main pulse;

wherein the first interval is in a range of 2 AL to 3 AL, and the second interval is in a range of 3 AL to 6 AL, provided that AL is a time during which a pressure wave generated in the ink channel communicating with the pressure chamber due to the change in the volume of the pressure chamber, is propagated one way in a longitudinal direction of the ink channel.

2. The ink-droplet jetting apparatus according to claim 1, wherein a number of pulses which are included in the drive pulse signal is even.

3. The ink-droplet jetting apparatus according to claim 2, wherein following relationships are satisfied:

$0.8\ AL \leqq Tm1 \leqq 1.3\ AL$, $2.0\ AL \leqq W1 \leqq 3.0\ AL$, $0.1\ AL \leqq Ts1 \leqq 0.4\ AL$, $3.0\ AL \leqq W2 \leqq 6.0\ AL$, $0.8\ AL \leqq Tm2 \leqq 1.3\ AL$, $2.0\ AL \leqq W3 \leqq 3.0\ AL$, and $0.1\ AL \leqq Ts2 \leqq 0.4\ AL$;

provided that Tm1 is a pulse width of the first main pulse, Tm2 is a pulse width of the second main pulse, Ts1 is a pulse width of the first regulating pulse, Ts2 is a pulse width of the second regulating pulse, W1 is the first interval, W2 is the second interval, and W3 is a third interval between a tail end of the second main pulse and a head end of the second regulating pulse.

4. The ink-droplet jetting apparatus according to claim 3, wherein following relationships are further satisfied $1.05\ AL \leqq Tm1 \leqq 1.25\ AL$, $2.25\ AL \leqq W1 \leqq 2.9\ AL$, $0.1\ AL \leqq Ts1 \leqq 0.4\ AL$, $5.0\ AL \leqq W2 \leqq 5.4\ AL$, $1.05\ AL \leqq Tm2 \leqq 1.25\ AL$, $2.25\ AL \leqq W3 \leqq 2.75\ AL$, and $0.1\ AL \leqq Ts2 \leqq 0.4\ AL$.

5. The ink-droplet jetting apparatus according to claim 1, wherein a voltage in a range of a first voltage and a second voltage is applied to the actuator; and a width of each of the main pulses is set to be a period to an extent that the voltage, applied to the actuator, has a period during which the voltage reaches from the first voltage to the second voltage, and a width of each of the first and second regulating pulses is set to be a period to an extent that the voltage, applied to the actuator, has a period during which the voltage does not reach from the first voltage to the second voltage.

6. The ink-droplet jetting apparatus according to claim 1, wherein each of the first and second main pulses and the first and second regulating pulses drives the actuator to increase the volume of the pressure chamber at a head end thereof, and then decrease the volume of the pressure chamber at a tail end thereof.

7. The ink-droplet jetting apparatus according to claim 1, wherein the actuator is a piezoelectric element which is displaced with respect to the pressure chamber when a voltage is applied to the piezoelectric element.

8. The ink-droplet jetting apparatus according to claim 1, wherein the signal control unit includes:

a drive pulse generating mechanism which generates a pulse signal including a first drive pulse signal for driving the actuator selectively in a predetermined jetting cycle to form the one dot and which has a plurality of pulses for jetting the plurality of droplets of the ink respectively and generated within the predetermined jetting cycle, and a second drive pulse signal which includes the drive pulse signal in which the plurality of pulses is generated during a jetting cycle and an adjacent jetting cycle thereto; and a drive pulse selecting mechanism which selects one of the first and second pulse signals, based on a presence or an absence of dot information of the adjacent jetting cycle, and outputs the selected signal to the actuator; and the drive pulse selecting mechanism selects the second drive pulse signal when dot information of the predetermined jetting cycle is 'jetting', and dot information of a subsequent jetting cycle to the predetermined jetting cycle is 'no jetting'.

9. An ink-droplet jetting apparatus which forms one dot by jetting a plurality of droplets of an ink onto a recording medium, comprising:

a pressure chamber in which the ink is filled;

an ink channel which communicates with the pressure chamber and which is elongated in a predetermined direction;

an actuator which faces the pressure chamber, and which changes a volume of the pressure chamber to jet the droplets of the ink; and a signal control unit which supplies a drive pulse signal for driving the actuator to form the one dot, the drive pulse signal including: three main pulses for a jetting operation; a first regulating pulse for suppressing a residual vibration of the ink in the pressure chamber caused by a main pulse among the main pulses immediately before the first regulating pulse, the first regulating pulse being inserted between the three main pulses at a first interval from the main pulse immediately before the first regulating pulse and at a second interval from another main pulse among the main pulses immediately after the first regulating pulse; and a second regulating pulse for suppressing a residual vibration of the ink in the pressure chamber caused by the last pulse of the main pulses, the second regulating pulse being added in continuation with the three main pulses;

wherein the first interval is in a range of 0.7 AL to 1.2 AL, and the second interval is in a range of 4.5 AL to 6.5 AL, provided that AL is a time during which a pressure wave, generated in the ink channel communicating with the pressure chamber due to the change in the volume of the pressure chamber, is propagated one way in a longitudinal direction of the ink channel.

10. The ink-droplet jetting apparatus according to claim 9, wherein a number of pulses which are included in the drive pulse signal is even.

11. The ink-droplet jetting apparatus according to claim 10, wherein following relationships are satisfied:

0.8 AL≦Tm1≦1.3 AL,
0.7 AL≦W1≦1.2 AL,
0.15 AL≦Ts1≦0.3 AL,
4.5 AL≦W2≦6.5 AL,
0.8 AL≦Tm2≦1.3 AL,
0.7 AL≦W3≦1.2 AL,
0.15 AL≦Ts2≦0.3 AL,
4.5 AL≦W4≦6.5 AL,
0.8 AL≦Tm3≦1.3 AL,
0.7 AL≦W5≦1.2 AL, and
0.15 AL≦Ts3≦0.3 AL;

provided that Tm1 is a pulse width of the first main pulse of the main pulses, Tm2 is a pulse width of the second main pulse of the main pulses, Tm3 is a pulse width of the third main pulse of the main pulses, the first regulating pulse is inserted between the first main pulse and the second main pulse, and Ts1 is a pulse width of the first regulating pulse, Ts2 is a pulse width of the first regulating pulse, Ts3 is a pulse width of the second regulating pulse, W1 is an interval between a tail end of the first main pulse and a head end of the first regulating pulse supplied next to the first main pulse, W2 is an interval between a head end of the second main pulse and a tail end of the first regulating pulse immediately before the second main pulse, W3 is an interval between a tail end of the second main pulse and a head end of the first regulating pulse supplied next to the second main pulse, W4 is an interval between a head end of the third main pulse and a tail end of the first regulating pulse immediately before the third main pulse, and W5 is an interval between a tail end of the third main pulse and a head end of the second regulating pulse supplied next to the third main pulse.

12. The ink-droplet jetting apparatus according to claim 11, wherein following relationships are further satisfied:

1.0 AL≦Tm1≦1.25 AL,
0.85 AL≦W1≦1.0 AL,
0.15 AL≦Ts1≦0.3 AL,
4.75 AL≦W2≦5.75 AL,
1.0 AL≦Tm2≦1.25 AL,
0.85 AL≦W3≦1.0 AL,
0.15 AL≦Ts2≦0.3 AL,
4.75 AL≦W4≦5.75 AL,
1.0 AL≦Tm3≦1.25 AL,
0.85 AL≦W5≦1.0 AL, and
0.15 AL≦Ts3≦0.3 AL.

13. The ink-droplet jetting apparatus according to claim 9, wherein a voltage in a range of a first voltage and a second voltage is applied to the actuator; and a width of each of the main pulses is set to be a period to an extent that the voltage, applied to the actuator, has a period during which the voltage reaches from the first voltage to the second voltage, and a width of each of the first and second regulating pulses is set to be a period to an extent that the voltage, applied to the actuator, has a period during which the voltage does not reach from the first voltage to the second voltage.

14. The ink-droplet jetting apparatus according to claim 9, wherein each of the three main pulses and the first and second regulating pulses drives the actuator to increase the volume of the pressure chamber at a head end thereof, and then decrease the volume of the pressure chamber at a tail end thereof.

15. The ink-droplet jetting apparatus according to claim 9, wherein the actuator is a piezoelectric element which is displaced with respect to the pressure chamber when a voltage is applied to the piezoelectric element.

16. The ink-droplet jetting apparatus according to claim 9, wherein the signal control unit includes:

a drive pulse generating mechanism which generates a pulse signal including a first drive pulse signal for driving the actuator selectively in a predetermined jetting cycle to form the one dot and which has a plurality of pulses for jetting the plurality of droplets of the ink respectively and generated within the predetermined jetting cycle, and a second drive pulse signal which includes the drive pulse signal in which the plurality of pulses is generated during a jetting cycle and an adjacent jetting cycle thereto; and a drive pulse selecting mechanism which selects one of the first and second pulse signals, based on a presence or an absence of dot information of the adjacent jetting cycle, and outputs the selected signal to the actuator; and the drive pulse selecting mechanism selects the second drive pulse signal when dot information of the predetermined jetting cycle is 'jetting', and dot information of a subsequent jetting cycle to the predetermined jetting cycle is 'no jetting'.

17. An ink-droplet jetting apparatus which forms one dot by jetting a plurality of droplets of an ink onto a recording medium, comprising:

a pressure chamber in which the ink is filled;

an ink channel which communicates with the pressure chamber and which is elongated in a predetermined direction;

an actuator which faces the pressure chamber, and which changes a volume of the pressure chamber to jet the droplets of the ink; and a signal control unit which supplies a drive pulse signal for driving the actuator to form the one dot, the drive pulse signal including: three main pulses for a jetting operation; a first regulating pulse for suppressing a residual vibration of the ink in the pressure chamber caused by the second main pulse of the main pulses, the first regulating pulse being inserted at a first interval from the second main pulse of the main pulses and at a second interval from the third main pulse of the main pulses; and a second regulating pulse for suppressing a residual vibration of the ink in the pressure chamber caused by the third main pulse, the second regulating pulse being added next to the three main pulses;

wherein the first interval is in a range of 1.5 AL to 3 AL, and the second interval is in a range of 1.5 AL to 6 AL, provided that AL is a time during which a pressure wave, generated in the ink channel communicating with the pressure chamber due to the change in the volume of the pressure chamber, is propagated one way in a longitudinal direction of the ink channel.

18. The ink-droplet jetting apparatus according to claim 17, wherein following relationships are satisfied:

0.6 AL≦Tm1≦1.2 AL, 1.0 AL≦W1≦1.8 AL, 0.7 AL≦Tm2≦1.45 AL, 1.5 AL≦W2≦3.0 AL, 0.15 AL≦Ts1≦0.3 AL, 1.5 AL≦W3≦6.0 AL, 0.7 AL≦Tm3≦1.4 AL, 0.5 AL≦W4≦1.0 AL, and 0.15 AL≦Ts2≦0.38 AL provided that Tm1 is a pulse width of the first main pulse of the main pulses, Tm2 is a pulse width of the second main pulse of the main pulses, Tm3 is a pulse width of the third main pulse of the main pulses, Ts1 is a pulse width of the first regulating pulse supplied next to the second main pulse, Ts2 is a pulse width of the second regulating pulse supplied next to the third main pulse, W1 is an interval between a tail end of the first main pulse and a head end of the second main pulse supplied next to the first main pulse, W2 is an interval between a tail end of the second main pulse and a head end of the first regulating pulse supplied next to the second main pulse, W3 is an interval between a head end of the third main pulse and a tail end of the first regulating pulse immediately before the third main pulse, and W4 is an interval between a tail end of the third main pulse and a head end of the second regulating pulse supplied next to the third main pulse.

19. The ink-droplet jetting apparatus according to claim 18, wherein following relationships are further satisfied:

0.6 AL≦Tm1≦0.85 AL, 1.2 AL≦W1≦1.58 AL, 0.88 AL≦Tm2≦1.25 AL, 2.25 AL≦W2≦2.38 AL, 0.2 AL≦Ts1≦0.3 AL, 1.88 AL≦W3≦5.75 AL, 0.7 AL≦Tm3≦1.12 AL, 0.63 AL≦W4≦0.75 AL, and 0.25 AL≦Ts2≦0.38 AL.

20. The ink-droplet jetting apparatus according to claim 17, wherein a voltage in a range of a first voltage and a second voltage is applied to the actuator; and a width of each of the main pulses is set to be a period to an extent that the voltage, applied to the actuator, has a period during which the voltage reaches from the first voltage to the second voltage, and a width of each of the first and second regulating pulses is set to be a period to an extent that the voltage, applied to the actuator, has a period during which the voltage does not reach from the first voltage to the second voltage.

21. The ink-droplet jetting apparatus according to claim 17, wherein each of the three main pulses and the first and second regulating pulses drives the actuator to increase the volume of the pressure chamber at a head end thereof, and then decrease the volume of the pressure chamber at a tail end thereof.

22. The ink-droplet jetting apparatus according to claim 17, wherein the actuator is a piezoelectric element which is displaced with respect to the pressure chamber when a voltage is applied to the piezoelectric element.

23. The ink-droplet jetting apparatus according to claim 17, wherein the signal control unit includes:

a drive pulse generating mechanism which generates a pulse signal including a first drive pulse signal for driving the actuator selectively in a predetermined jetting cycle to form the one dot and which has a plurality of pulses for jetting the plurality of droplets of the ink respectively and generated within the predetermined jetting cycle, and a second drive pulse signal which includes the drive pulse signal in which the plurality of pulses is generated during a jetting cycle and an adjacent jetting cycle thereto; and a drive pulse selecting mechanism which selects one of the first and second pulse signals, based on a presence or an absence of dot information of the adjacent jetting cycle, and outputs the selected signal to the actuator; and the drive pulse selecting mechanism selects the second drive pulse signal when dot information of the predetermined jetting cycle is 'jetting', and dot information of a subsequent jetting cycle to the predetermined jetting cycle is 'no jetting'.

* * * * *